US007757414B2

(12) United States Patent
Tonkel

(10) Patent No.: US 7,757,414 B2
(45) Date of Patent: Jul. 20, 2010

(54) FOOTWEAR WITH PIVOTAL AND/OR ROTATABLE TONGUE

(75) Inventor: Raymond F. Tonkel, Sudbury, MA (US)

(73) Assignee: U Turn Sports Co. LLC, Wildwood, NJ (US)

( * ) Notice: Subject to any disclaimer, the term of this patent is extended or adjusted under 35 U.S.C. 154(b) by 899 days.

(21) Appl. No.: 11/512,846

(22) Filed: Aug. 30, 2006

(65) Prior Publication Data

US 2006/0288614 A1 Dec. 28, 2006

Related U.S. Application Data

(63) Continuation-in-part of application No. 10/771,610, filed on Feb. 4, 2004, now Pat. No. 7,117,614.

(51) Int. Cl.
*A43B 23/26* (2006.01)

(52) U.S. Cl. ..... 36/136; 36/54; 36/45

(58) Field of Classification Search ..... 36/136, 36/132, 54, 45
See application file for complete search history.

(56) References Cited

U.S. PATENT DOCUMENTS

| | | | | | |
|---|---|---|---|---|---|
| 2,948,070 | A | | 8/1960 | Lewis | |
| 3,204,346 | A | | 9/1965 | Lockard, et al | |
| 4,372,060 | A | | 2/1983 | Adamik | |
| 4,485,496 | A | * | 12/1984 | Shanks, Jr. | 2/247 |
| 4,712,319 | A | * | 12/1987 | Goria | 36/137 |
| 4,805,321 | A | | 2/1989 | Tonkel | |
| 5,136,726 | A | * | 8/1992 | Kellin et al. | 2/244 |
| 5,459,947 | A | | 10/1995 | Lasher | |
| D381,491 | S | * | 7/1997 | Pallera | D2/900 |
| 5,659,979 | A | | 8/1997 | Sileo | |
| 5,673,501 | A | * | 10/1997 | Mathews | 36/136 |
| 5,800,900 | A | * | 9/1998 | Mitchell | 428/100 |
| 6,212,797 | B1 | | 4/2001 | Merry | |
| 6,321,466 | B1 | | 11/2001 | Bordin et al. | |
| 2002/0029494 | A1 | | 3/2002 | Small | |
| 2002/0124433 | A1 | | 9/2002 | Pan | |
| 2004/0159022 | A1 | * | 8/2004 | Winford et al. | 36/136 |
| 2004/0237351 | A1 | * | 12/2004 | Howell | 36/136 |

* cited by examiner

*Primary Examiner*—Ted Kavanaugh
(74) *Attorney, Agent, or Firm*—Paul M. Denk

(57) ABSTRACT

A revolving tongue for application to footwear provided a central pivot point that rotatably connects to a crossbar of the footwear, the crossbar extending between the lateral openings of the shoe, at upper edges of the shoe quarter portions. The tongue may be rotated, to disclose variations in coloration material and design for the shoes, as applied. A pivot pin or other connector secures the tongue, approximately centrally, to the crossbar, a guide may be provided at the lower or lateral edges of the circular tongue, secured within the shoe, to act as a guide to retain the tongue for its circular motion. In addition, openings may be provided within the upper quarter portions of the shoe, so the tongue coloration can show therethrough, and change, as the tongue is being pivoted for a different setting, and in addition, can also provide for aeration of the foot, at such location.

7 Claims, 17 Drawing Sheets

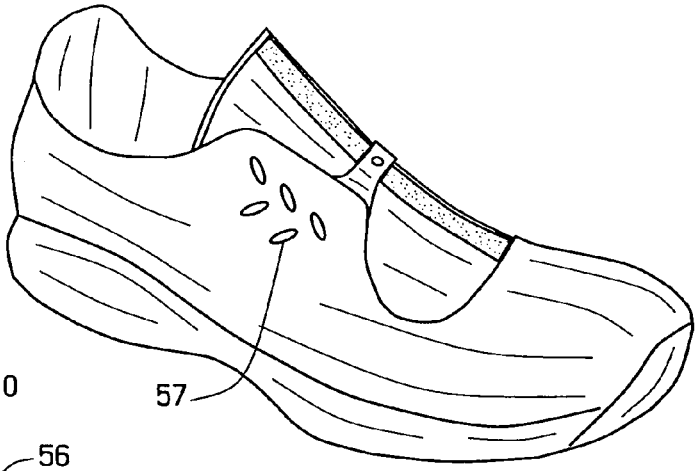
FIG. 17A
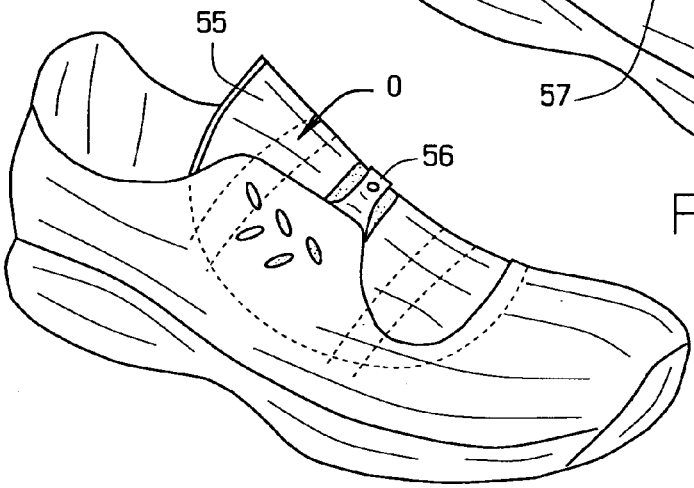
FIG. 17B
FIG. 18A
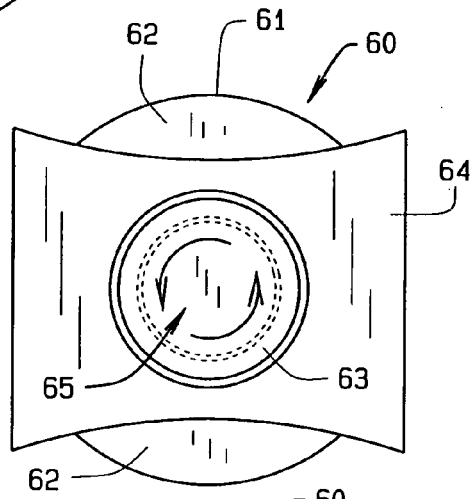
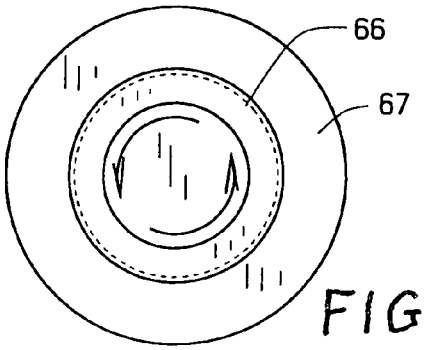
FIG.19A
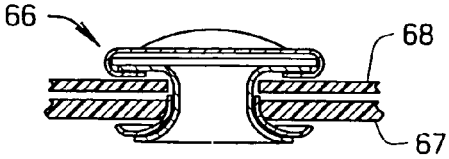
FIG. 19
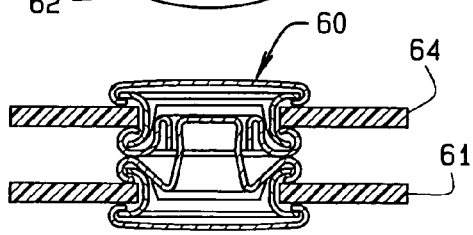
FIG. 18

FOOTWEAR WITH PIVOTAL AND/OR ROTATABLE TONGUE

CROSS REFERENCE TO RELATED APPLICATIONS

This is a continuation-in-part of application Ser. No. 10/771,610 filed Feb. 4, 2004, now U.S. Pat. No. 7,117,614

BACKGROUND OF THE INVENTION

This invention relates generally to a turnable gusset or tongue for a shoe or other related footwear, wherein the tongue may contain a variety of coloration or designs, and upon its pivot, may expose the changeable coloration for viewing, and completely change the style and coloration of the shoe being worn.

Various types of prior art designs for different styles of footwear have long been available in the art, and primarily are useful for adding to the decorativeness and style for the structure of the footwear. For example, in the shoe of Lewis, as disclosed in U.S. Pat. No. 2,948,070, therein is shown a high-heel type of shoe, as can be noted, with the vamp stitched to the upper surface of the sole. The vamp is designed to have different colored surfaces, to add to the variation in the decorativeness and coloration for the shown heeled shoe.

The patent to Lockard, et al, U.S. Pat. No. 3,204,346, shows another type of interchangeable sole and upper for shoes. The sole is provided with tracks thereon, that are arranged along a curve along the upper peripheral edge of the sole, and then a shoe upper or vamp can be slid therein to provide for different types of styles of vamps for the shown shoe.

The publication No. US2002/0124433 A1, to Pan, of Taiwan, defines a sports sandal incorporating various straps, with placing tapes that can be attached or detached to the straps, apparently for varying the coloration or design of the sandal, as noted.

Various other concepts for changing the appearance and the aesthetics of footwear can be seen in the variety of patents that provide for a removal and reversal or changing of its tongue or gusset, as known in the prior art. For example, in the published application US2002/0029494 A1, a shoe tongue held by Velcro, buttons, or even a zipper, can provide for removal of tongue, and its interchanging with another shoe tongue, to provide for variations, apparently, in the tongue design.

The prior patent to Tonkel, U.S. Pat. No. 4,805,321, shows a reversible tongue that is held by Velcro, at its bottom edge, to the upper approximate edge of the vamp, so that the tongue can be removed, and reversed, as desired.

The patent to Merry, U.S. Pat. No. 6,212,797 B1, shows footwear with a detachable spat. This spat can be held in place by means of adhesives, snaps, Velcro, or any combination thereof, as noted in this patent.

The patent to Bordin, U.S. Pat. No. 6,321,466 B1, shows a removable tongue for a shoe and attachment device therefore. A flexible band, like a belt, is used for holding the tongue of this footwear in place.

The patent to Lasher, U.S. Pat. No. 5,459,947, shows a decorative shoe tongue simulating and lace securing device, where the tongue is apparently held by Velcro fastened to the lacing for the shown shoe.

The patent to Sileo, U.S. Pat. No. 5,659,979, shows transparent footwear with interchangeable tongue and insole and kit therefore.

The patent to Adamik, U.S. Pat. No. 4,372,060, shows the construction of a tongue for a shoe or the like article.

These are examples of prior art constructions, for footwear or shoes, wherein the gusset or tongue, or related components, may be modified, have different coloration, and when removed and reversed, can provide for variations in the shoe design, the ventilation and breathable characteristics of the footwear, and coloration, as desired.

The current invention seeks to provide further modifications to the structure of footwear, in order to add to the variations on usage and appearance for shoes, generally enhancing its styling, and to increase the attractiveness of the footwear, by providing means for inherently changing the positioning of the shoe tongue, to change its design and coloration, as desired.

SUMMARY OF THE INVENTION

This invention contemplates the formation of footwear in general, which may be used with any style of shoe, whether it is a woman's shoe, men's dress shoes, athletic type shoes, or running shoes, or any other shoes that incorporate a tongue or gusset into its design and construction. The footwear includes, but is not limited, the usual style of shoe having a sole, vamp, quarter portions, counter, and a tongue or gusset secured therein. The essence of this invention is the fabrication and design for the tongue or gusset as used in the footwear construction.

In the preferred embodiment, the gusset will be of a pivotal or rotatable type, where the tongue can be turned to expose one portion of its surface, which may add one coloration to the style of the shoe, or it may be turned further, to add a different design or coloration to the shoe, to completely change its aesthetics, or the rotatable tongue may be removed, from its pivot point, and reversed, and provide an entirely different array of designs or colorations, to add to the variety of appearances that can be given to the shoe upon manipulation of its rotatable tongue. Furthermore, one portion or half of the rotatable tongue may be formed of a more solid fabric, while the upper half may be formed of a more mesh like material. Hence, when the tongue is turned, and the mesh material is at the upper surface, this will provide greater ventilation for the foot, at that location, and in addition, that portion of the tongue that underlies openings provided at the open quarter portion of the shoe, will allow for ventilation of the foot, through these openings, as can be understood.

This invention can pertain to an athletic shoe, casual or dress shoes, or even boots. Means are provided for accommodating the pivotal or rotation of the shoe's tongue. The means normally incorporate a pivot point, that is held by a strap or band that spans the space between the edges of the upper quarter portions that form the gusset spacing. Then, a pivot means, such as a pin, or a snap, are provided for holding the circular, or approximately circular, tongue in position, so that it can be rotated, to add to the coloration of the designed footwear. Or, the snap or pin may separate, to allow the tongue to be removed, and it can be reversed, and resnapped into a pivotal position, to allow the underside of the tongue to function as the exposed surface, to add further coloration or design to the shoe structure.

In addition, in those embodiments where the tongue are of a circular design, and therefor extend further laterally underneath of the approximate upper quarter portions of the footwear, the quarter portions themselves may have openings provided therethrough, so that the underlying tongue can be seen, and its design or coloration be exposed, to add further variation to the design for the shoe, and enhance its aesthetics.

In addition, in order to further add to the functionality of the shoe designs, as explained above, there may be a turning knob operatively associated with the pivot pin, and the held tongue, and the turning knob can be rotated, in order to facilitate the change of the location of the tongue, within its structural support within the gusset spacing, provided within this footwear. Furthermore, in order to be assured that the circular tongue will remain in place, a guide may be provided approximate the upper edge of the vamp, and embrace the lower arcuate edge of the tongue or gusset, in order to embrace the lower edge of the tongue, during its turning, to assure that it remains in place, while being manipulated to change the shoe design, and when the footwear is being worn. This assures that the lower end of the tongue will not turn under, or be folded, as when the shoe is fitted for wearing.

In addition to the foregoing, the structure of this invention may include a pinwheel, a pinwheel style of display, not too unlike that as shown in FIG. 2 of the drawings, and it may insert either at the location of the tongue gusset, as previously explained, or it may locate and attach at the quarter portion of the shoe, and turned there at, as by a knob or other turning mechanism, so as to display part of the decorative surface of the pinwheel through openings or slots provided within the various quarter portions for the shoe, so as to vary the design, coloration, and indicia, that shows thereat. Or, the pinwheel, applied at the tongue or gusset portion of the shoe, may overlay the tongue, or be under it, or in it, and provide for different displays through, for example, slots provided in the tongue, or even laterally of the lacing opening, where slots may be provided through the upper quarter portion of the footwear, so as to allow the pinwheel surface to show therein, and to vary coloration, design, etc.

These are examples of the variations that can be provided from this style of structural enhancement that is provided to the footwear, particularly within the region of its tongue or gusset, and significantly add to its stylization, when displayed, and when worn. For example, the different coloration provided upon the tongue may match that of the school colors for the student wearing the shoe. The coloration can be changed, so as to expose the school colors, at sporting events, by the fans, and can even be constructed into the athletic shoe, or basketball or football shoe, worn by the athlete, so as to expose the school colors, in different variations, throughout the contest.

It is, therefore, the primary object of this invention to provide a tongue that may be rotated, so as to vary the style, design, and coloration for the footwear being worn.

It is another object of this invention to provide a revolvable tongue that may have different styles of appearance upon either its upper and/or lower surfaces, so that the tongue can be rotated, and completely change the appearance and attractiveness of the shoe, to the interest of the footwear owner. As stated, the consumer can coordinate with team colors, fashion trends, and the like.

Another object of this invention is to provide a pivotal means that can effectively retain a circular, or other shaped tongue, to the footwear, but yet allow the tongue to be rotated, in its setting.

It is still another object of this invention to provide a tongue which can furnish aeration and ventilation to the foot, where are all or part of the circular tongue may be made of a mesh material, so that the foot can be ventilated when the mesh material extends upwardly in the shoe, or is arranged laterally, and exposes the foot through the openings furnished at the upper quarter portion of the designed shoe.

These and other objects may become more apparent to those skilled in the art upon reviewing the summary of this invention, and upon undertaking a study of the description of its preferred embodiment, in view of the drawings.

BRIEF DESCRIPTION OF THE DRAWINGS

In referring to the drawings,

FIG. 17A shows a further variation in a pivotal tongue;

FIG. 17B shows the tongue of 17*a* turned, to disclose a different design;

FIG. 18 shows a cross-sectional view of the pinwheel mechanism useful for turning the pivotal tongue;

FIG. 18A shows a top plan view thereof;

FIG. 19 shows a modification to the pinwheel mechanism useful for turning of the pivotal tongue;

FIG. 19A shows a top plan view of the said mechanism;

DESCRIPTION OF THE PREFERRED EMBODIMENT

As can be seen from the variety of drawings and figures as provided for disclosing the concept of this invention, the idea is to provide a shoe tongue that rotates on a center pivot in order to be able to create different optional effects, from a design standpoint, and a coloration standpoint, all in one shoe embodiment. Traditional shoe tongues are stitched down at the bottom of the eye stay, at the upper edge of the vamp, and therefore, remain stationary. With the rotatable or pivotal tongue design, of this invention, one can pivot the tongue around for multiple desired effects. The color change could be in the tongue area itself, or through a cutout within the upper quarter portions, to add to the variations and versatility of the designs embodied within the shoe structure, and capable of being instantly modified, simply through a pivotal of its associated rotatable tongue.

Various types of center pivotal means can be utilized, can be a pin structure, it may be a pin in combination with a clasp structure, so that the pin can be removed, the tongue reversed, and the pin reapplied, so that both the upper and lower surfaces of the tongue can display different colorations, and designs, to add to the multitude of aesthetics that can be obtained from the footwear through usage of this invention.

In addition, the tongues may be circularly shaped, polygonally shaped, or they may be shaped rectangularly, or to other side shapes, so that the tongue can be rotated from top to bottom, and yet provide different colorations, or designs, as desired. The tongue can also be contoured, so as to fit snugly within the confines of its pivotal mounting, and incorporate guide means, either at the bottom, proximate the upper edge of the vamp, or perhaps even internally, of the lateral portions of the shoe, so as to furnish a singular or multiple guides that retain the tongue's integrity, as it is being pivoted or rotated, in its set up for disclosing different colorations or designs.

Figure 1:
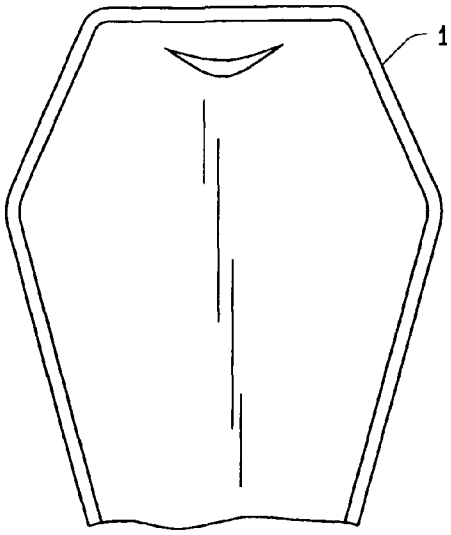
FIG. 1 is a top plan view of the standard gusset or tongue that is applied to footwear, where its bottom edge is stitched or otherwise secured to the upper edge of the vamp.

In referring specifically to the drawings, and in particular FIG. 1, this sketch shows the prior art style of tongue 1 that is normally applied in the footwear, such as a running shoe, and is stitched or otherwise secured, at its bottom, to the upper edge of the shoe vamp.

Figure 2:
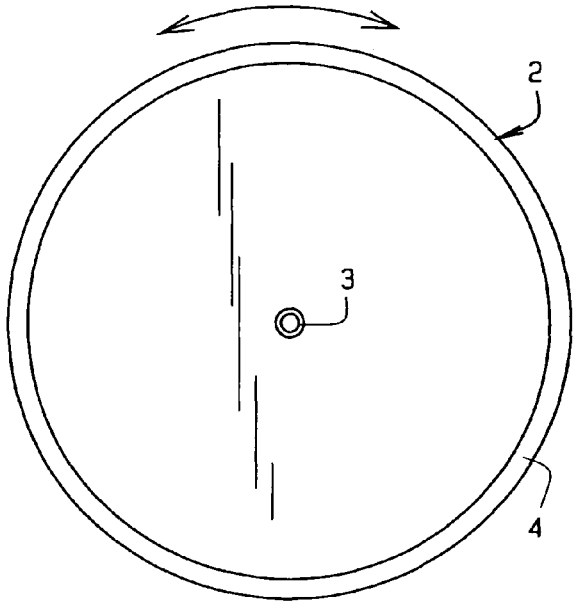
FIG. 2 shows the circular tongue of this invention.

The subject matter of this invention, on the other hand, is readily disclosed in FIG. 2. In this instance, the shown tongue 2 is of a circular design, and has an aperture 3 or other means for providing for pivoting, at its center, as can be noted. A cowling or edging is provided or otherwise stitched around the outer perimeter, as noted at 4.

Figure 3:
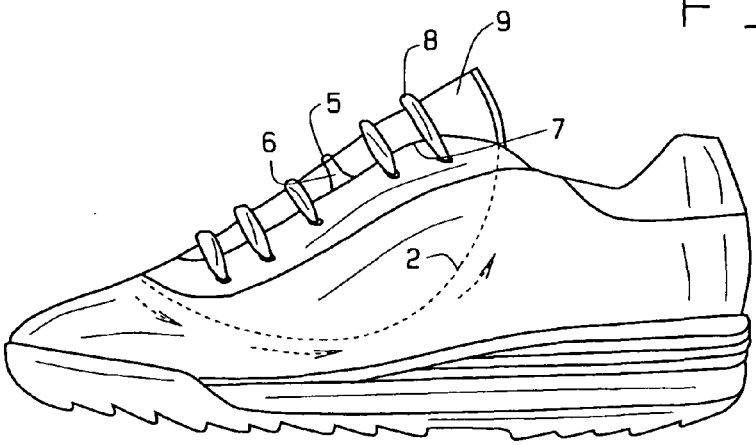
FIG. 3 shows, partially in hidden line, the circular tongue of this invention connected to its pivot point of the shown athletic shoe.
Figure 4:
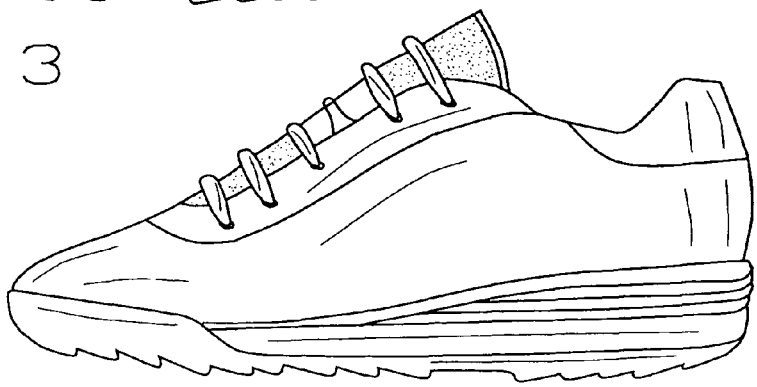
FIG. 4 is a view of the same shoe with the tongue being partially rotated, to disclose a different coloration.

When installed, and as can be seen in FIG. 3, the circular tongue 2 has a pivot point or pin 5 that cooperates through its aperture 3, centrally thereof, and connects with a crossbar or strap 6 that secures with the edges of the upper quarter portions, as at 7, and which normally arrange for the application of the lacing 8 as well known in the art. As can be seen, by means of the arrangement of the shown arrows, the circular tongue or gusset can be rotated, in either direction, so as to provide a first coloration, as shown at 9, through the upper surface of the shoe, along its lacing spacing, or the tongue can be turned, so as to display a different coloration, as at 10, so as to add to the versatility of the styling of the shoe as it is worn, as during an athletic event, or the like.

Figure 5:
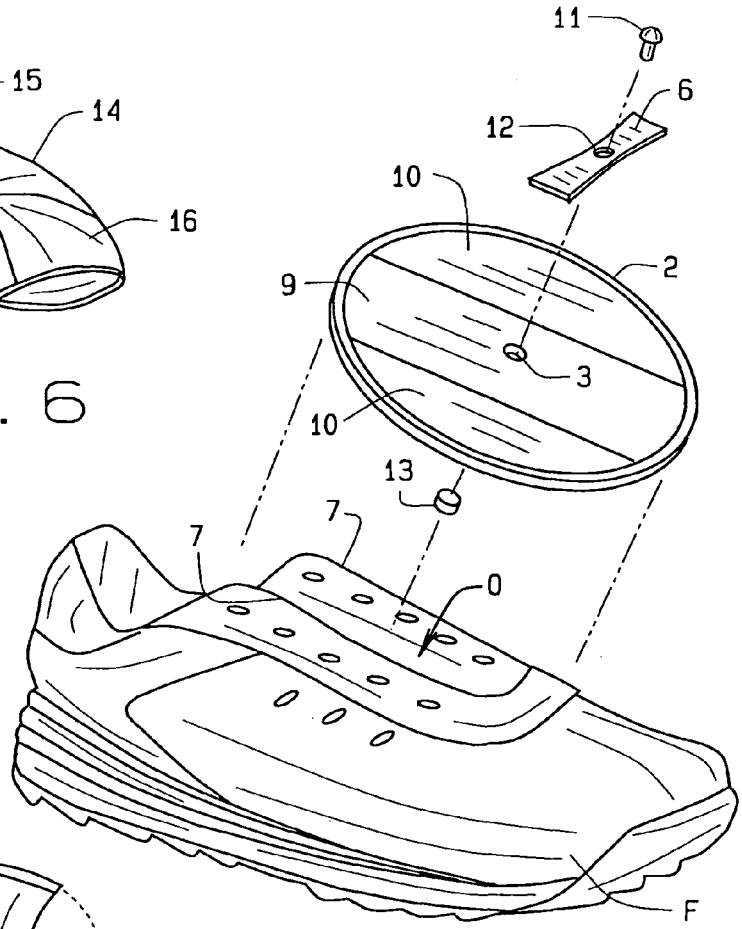
FIG. 5 is an exploded view of the shown running shoe, and its circular tongue with its attachment means.

The exploded view for the invention, as can be seen in FIG. 5, includes the footwear F, the support element, strap, or crossbar 6 is usually stitched or otherwise fastened to those lateral edges 7 of the upper quarter portion, and then the tongue 2 is located beneath the crossbar 6, within the shoe, so that portions of the tongue will be exposed through the opening, as at O, and provide for the benefits derived from usage of this type of convertible gusset, when applied. The pivot means, such as the fastener 11 extends through the opening 12 provided in the crossbar, through the aperture 3 of the circular tongue, and then is held by the receptacle or nut 13, to fixedly lock the tongue in place, during usage. Actually, the element 13 may be a flattened element, so that it contacts smoothly against the underside of the tongue 2, and does not extend down and impale upon the upper surface of the foot, during usage. Then, the fastener 11 can either be crimped therein, or held tightly to the receptacle 13, to secure the tongue for circular movement during its usage.

As can be seen from the appearance of the tongue 2, in FIG. 5, different colorations, such as the light color 9, and the dark colors 10, are provided upon the surface of the tongue, such that when the tongue is rotated, different colorations or combinations thereof may be exposed, to add to the styling of the shoe, as previously summarized. In addition, it is just as likely that similar type of colorations or designs may be applied to the bottom of the tongue 2, so that the tongue can be reversed, reapplied, for its circular movement, and add further styling to the shoe, during usage.

Figure 6:
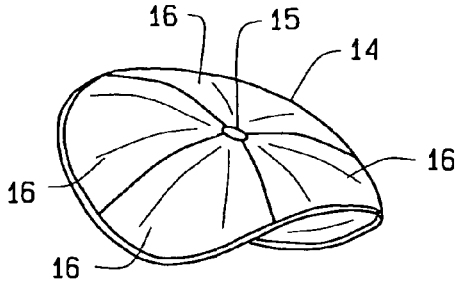
FIG. 6 shows a contoured tongue of the type that is pivotally secured to the shown footwear.
Figure 7:
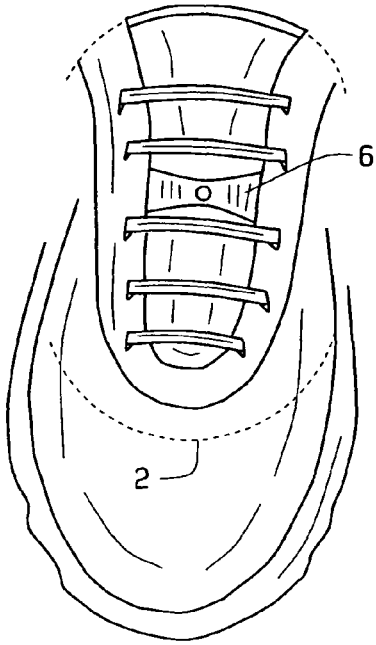
FIG. 7 shows a partial top view of the footwear disclosing the strap or bar to which the tongue pivotally connects.
Figure 7A:
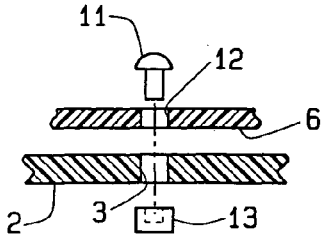
FIG. 7A shows the attachment means.
Figure 7B:
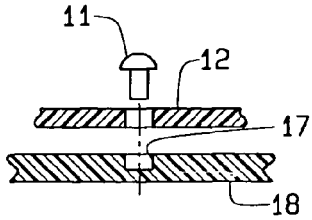
FIG. 7B shows a further attachment means.

An example of how the tongue will appear when applied within the footwear, can be seen in FIG. 6. As disclosed, the tongue 14, with its central aperture 15, will have a contoured shape to it, so as to facilitate its application and usage within the shoe, and may include a variety of patterns of different colorations or styling, as can be seen at 16, within its various quadrants. Further views disclosing the application of the circular tongue 2 within the shoe structure, can be seen in FIGS. 7 through 7B. As noted, the tongue fits within the shoe, under the crossbar 6, and locates therein for circular revolving, as can be seen. Actually, as previously commented, the circular revolving may be done in both directions. In addition, as can be noted, the crossbar may be formed of some type of elastomeric material, so as to provide some resiliency, and facilitate the insertion and application of the foot within the shoe, or its removal, during usage of the shown shoe. In addition, in 7*a* it can be seen how the fastener 11 extends down through the crossbar 6, through its aperture 12, and then further down through the tongue 2, and its aperture 3, to be held by the retainer 13. Or, as can be seen in FIG. 7B, the fastener 11 may pressure fit within the locking receptacle 17, of the tongue 18, after extending down through the crossbar 12, as can be seen. In this manner, the fastener will not extend below the tongue, and therefore, will not add to the inconvenience of the wearer of the shoe, during usage.

Figure 8:
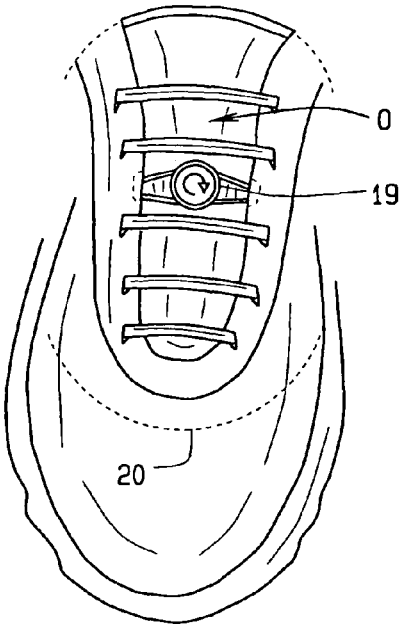
FIG. 8 shows a plan view of the footwear, disclosing its attachment bar, and is further showing a knob to facilitate turning of the circular tongue.
Figure 8A:
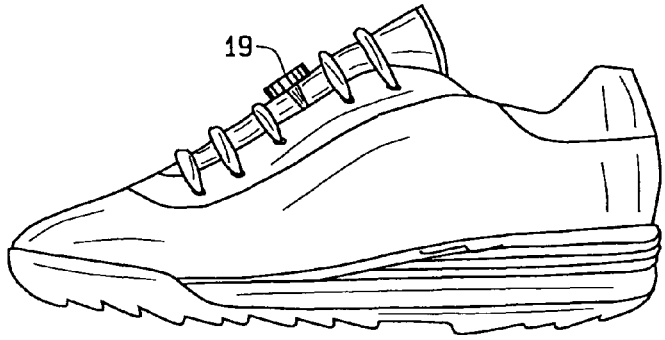
FIG. 8A provides a side view thereof.

As can be seen in FIGS. 8 and 8A, a further modification to the invention discloses how the fastener may be formed with a knob 19, and the knob may be fastened either by a nut or other fastener beneath the tongue, or secure into the tongue in a manner as shown and described in FIG. 7B, but in any event, the knob is provided for the convenience of the user, where it can be turned, in place, and thereby turn the circular tongue 20 in process, to vary the design of the gusset that shows through the opening O, of the shown shoe.

Figure 9B:
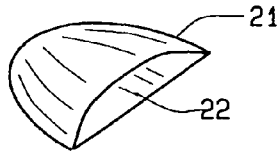
FIG. 9B shows the guide independently in a perspective view.
Figure 9:
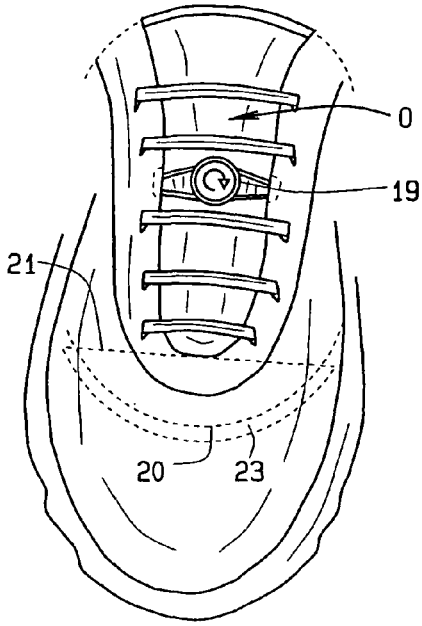
FIG. 9 shows similar footwear incorporating the circular tongue, but having a pocket liner at the upper edge of the vamp, to function as a guide for the lower part of the tongue to pivot therethrough.
Figure 9A:
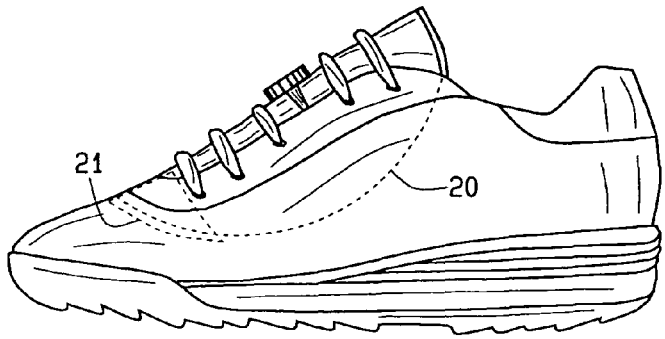
FIG. 9A shows a side view of the guide.

As a further convenience to the structure of this invention, and as can be seen in FIGS. 9 through 9B, there is further applied under the upper vamp V of the shoe, a guide 21, as can be noted. It may be adhesively secured within the shoe, at the shown location, or be stitched in place, but in any event, the guide includes a pocket 22, within it, that functions as a spacing, where the lower edge of the circular tongue 20 locates, as that segment of the tongue 23, so as to maintain the tongue in position, and keep the lower edge located therein, so that it does not curve or bend back upon itself, making it difficult to revolve the tongue during usage, in the manner of this invention. Thus, the guide 21 serves that purpose, to hold therein and guide the revolving of the tongue 20, during its turning in either direction.

Actually, the guide could take other forms, such as just a piece of arcuate fabric that may be stitched in place at the location as shown, internally of the shoe, and allow the lower edge of the tongue 20 to pass therethrough, and be maintained therein, to prevent a collapse of the tongue during usage. In addition, it is also possible that such guides 23 may be located laterally of the shoe, internally thereof, in the vicinity of the inner and outer quarter portions for the shown shoes, and guide the sides of the tongue, similarly, as it is being turned, and to prevent its collapse.

Figure 10A:
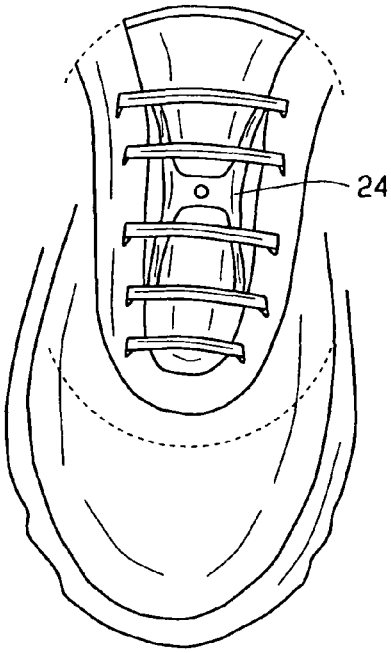
FIG. 10A shows another means, in lieu of the bar strap, for holding the circular tongue in place.
Figure 10B:
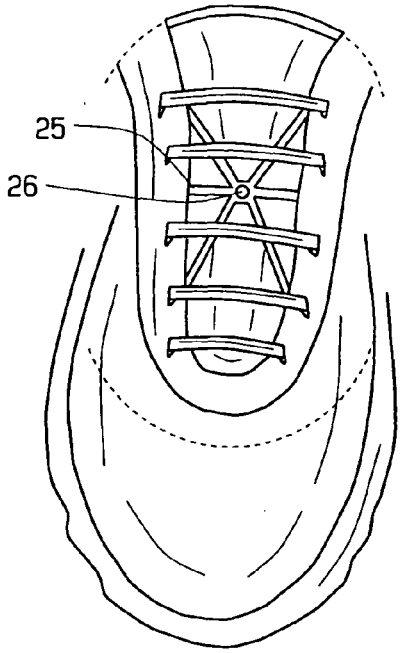
FIG. 10B shows another means for holding the circular tongue in place.
Figure 10C:
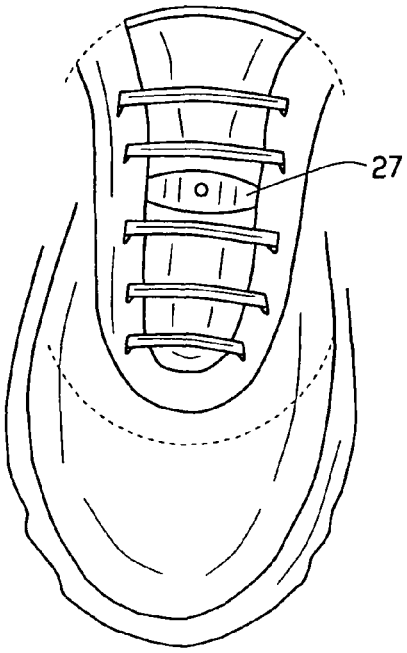
FIG. 10C shows another means for holding the circular tongue in place.
Figure 10D:
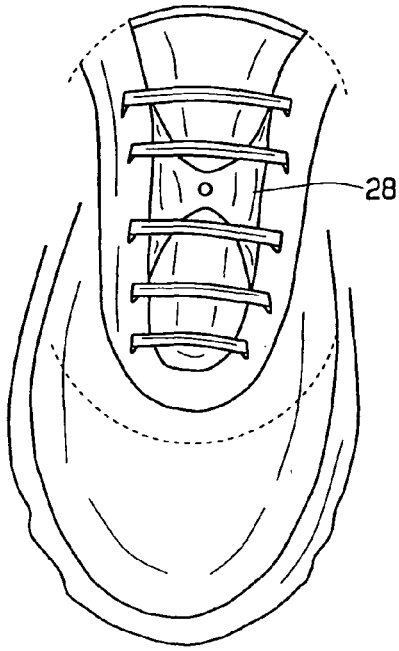
FIG. 10D shows another means for holding the circular tongue in place.

Various other styles for the crossbars 6 of this invention can be seen in FIGS. 10A through 10D. For example, in FIG. 10A, the crossbar may undertake a spider configuration, as can be seen at 24. Similarly, the crossbar may undertake the arrangement of a series of cords, as at 25, as can be seen in FIG. 10B. As noted, these types of cords may be formed of a molded elastomeric material, such as a bungee cord, having an aperture 26 provided centrally thereof, as at 26, to hold the fastening means for securing the tongue in place. 10*c* shows another form of crossbar 27. In addition, FIG. 10D shows a further modification for the crossbar 28.

Figure 11:
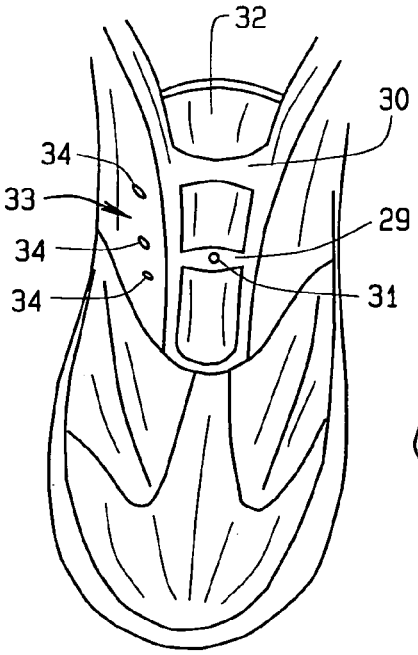
FIG. 11 shows the circular tongue held in place by means of an elastomeric support element.
Figure 11A:
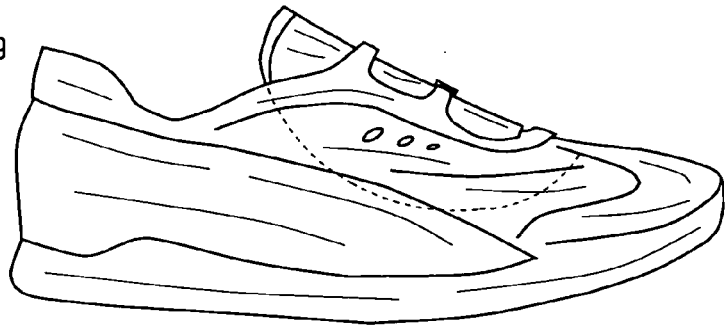
FIG. 11A is a side view thereof.

FIGS. 11 and 11A disclose a further modification in the structure of the shoe, as can be noted. In this instance, the crossbars may provide a plurality of such, as noted at 29 and 30, with the lower crossbar 29 having its aperture 31 provided therethrough for cooperating with a retainer (not shown), similar to that as shown in FIG. 7, to hold the circular tongue 32 in place. There is a further enhancement to the design of the circular tongue, as can be seen in this particular shoe. For example, in the upper quarter portion, as at 33, there are a series of openings provided therethrough, as at 34. Thus, the benefit of having this design structure provided within the shoe, on one or both sides of the shoe, allows the coloration of the tongue 32 to also show therethrough, to add to the enhanced appearance and design of the worn footwear.

Figure 12A:
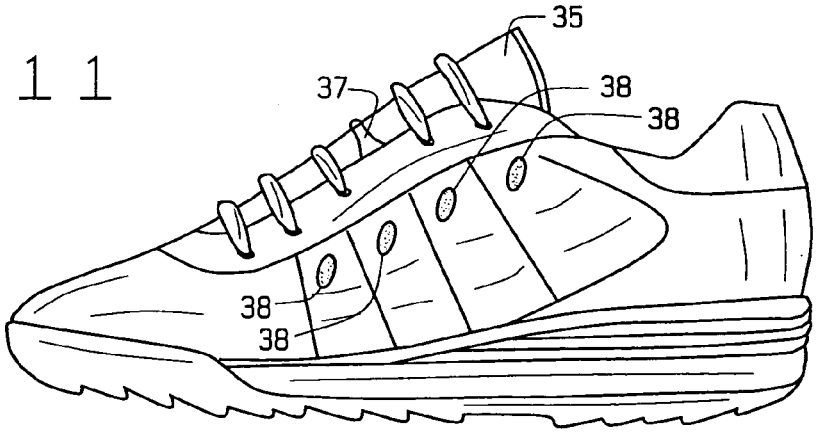
FIG. 12A shows a side view of the circular tongue, wherein the upper quarter portion provides apertures through which the coloration of the circular tongue is displayed.
Figure 12B:
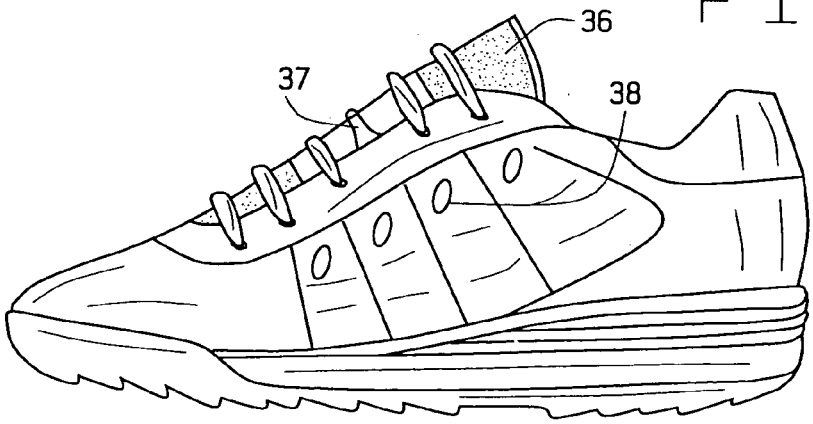
FIG. 12B shows the circular tongue pivoted, approximately a quarter turn, to show a different coloration through the quarter portion apertures.

The concept as previously reviewed is more aptly shown in FIGS. 12A and 12B. As can be seen, the circular tongue and its various colorations, as can be noted with the white shade as shown at 35, or the dark shade of coloration shown at 36, are disclosed as being located pivotally, by means of the crossbars 37, within their footwear structure. But, a series of openings, of various designs, as can be seen at 38, also allow for the coloration of the circular tongue to show therethrough, as can be noted in these figures. For example, in FIG. 12A, the revolving tongue has been arranged so that the dark color shows through the openings 38, while the light color 35, is arranged upwardly thereof. But, as the circular tongue is turned, the light color may show through the openings 38, as disclosed in FIG. 12B, while the dark color 37 shows upwardly of the designed shoe. These are examples as to how the tongue may be rotated, so as to vary the coloration and styles for the shown footwear. This allows for a changing of the appearance of the tongue, as it is being rotated.

Figure 13A:
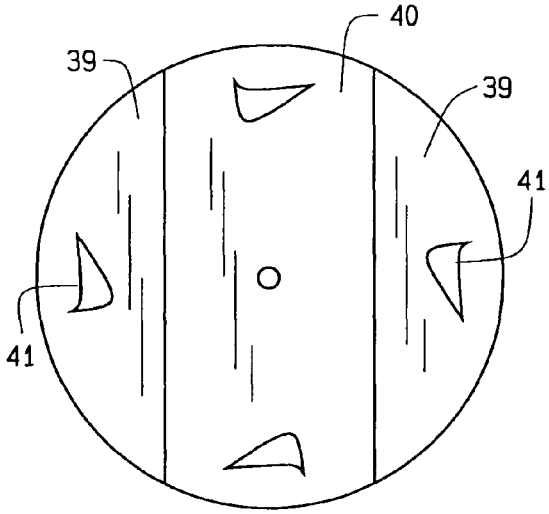
FIG. 13A shows a variation in a circular tongue design.
Figure 13B:
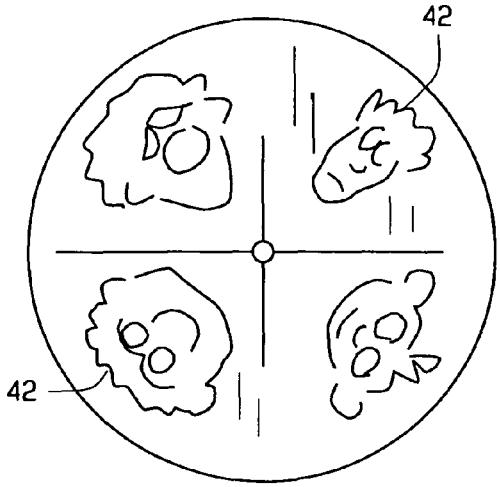
FIG. 13B shows another variation in a circular tongue design.
Figure 13C:
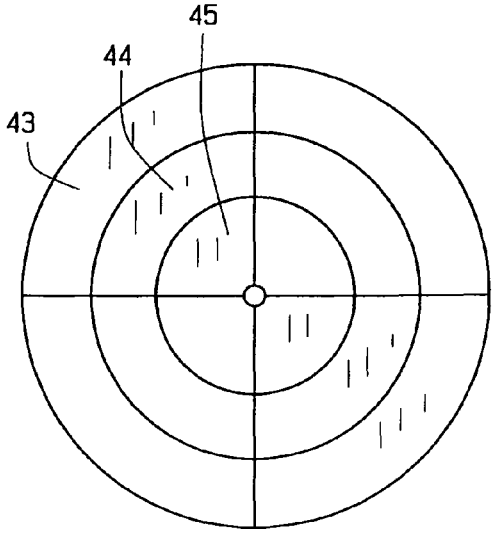
FIG. 13C shows another variation in a circular tongue design.
Figure 13D:
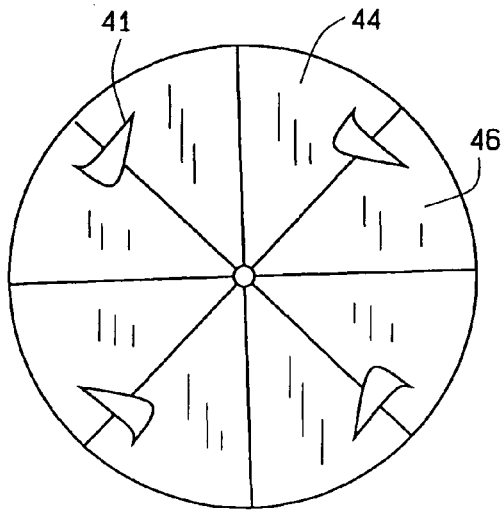
FIG. 13D shows another variation in a circular tongue design.
Figure 14A:
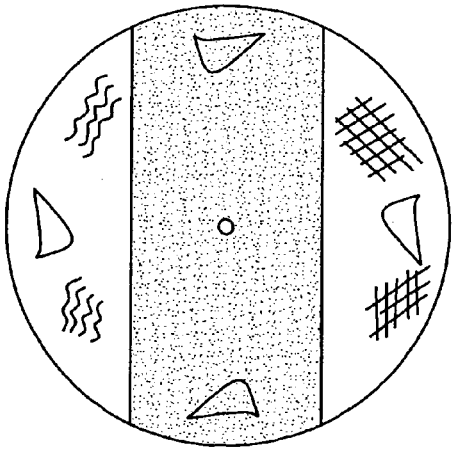
FIG. 14A shows another variation in the circular tongue design.
Figure 14B:
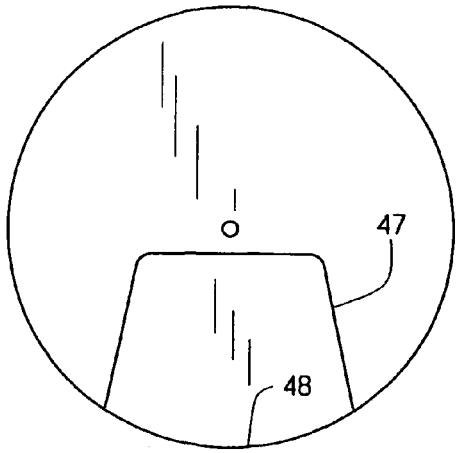
FIG. 14B shows another variation in the circular tongue design.
Figure 14C:
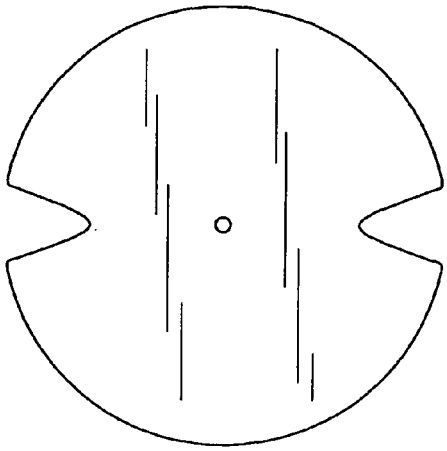
FIG. 14C shows another variation in the circular tongue design.
Figure 14D:
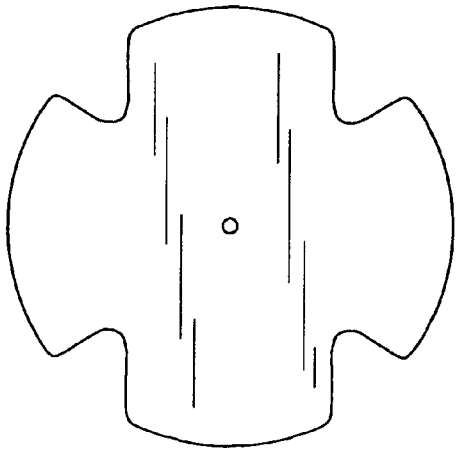
FIG. 14D shows another variation in the circular tongue design.

A further example of the various types of designs that can be provided for the circular tongue, can be seen in FIGS. 13A through 13D. For example, in 13A, various colorations may be provided upon sections of the tongue, as can be noted at 39 and 40, and in addition, various trademarks, one as shown at 41, may be disclosed. These will show up primarily through the opening O, provided through the footwear, when assembled. FIG. 13B shows how various types of caricatures or multiple characters as at 42, may be provided upon the circular tongue, and be disclosed. FIG. 13C shows how the coloration may be arranged in cylindrical patterns about the tongue, as noted at 43 through 45. Or, each quadrant of circular colors may change in further coloration, to add a variety of coloration to the shown shoes. FIG. 13D discloses further coloration patterns, as at 46, that may be used in combination with logos, or trademarks, as noted.

FIGS. 14A through 14D show other variations in designs, colorations, the shape of the circular tongue that may add to its attractiveness, when used. For example, as noted in FIG. 14B, the tongue may also include a pocket structure, as at 47, having its outer edge closed by Velcro, a zipper, or the like, as at 48. Thus, as the shoe is being worn, and it is desired to place something into the pocket, the shoe may be pivoted so the pocket opening elevates and is exposed at the top of the tongue, to allow access into its pocket. Then, once a coin, money, key, or the like, has been inserted therein, the tongue may be closed, and pivoted so that the pocket opening is arranged downward towards the upper edge of the vamp, to add to the securement, safety and concealment of the pocket, as the shoe is being worn. As can also be noted in FIGS. 14C and 14D, the tongue does not have to be completely circular, but may have cut patterns provided therein, that may add to the attractiveness of the worn shoe. In Addition, such a designed tongue may provide for a better form or fit around the contours of the upper foot, as can be understood.

Figure 15A:
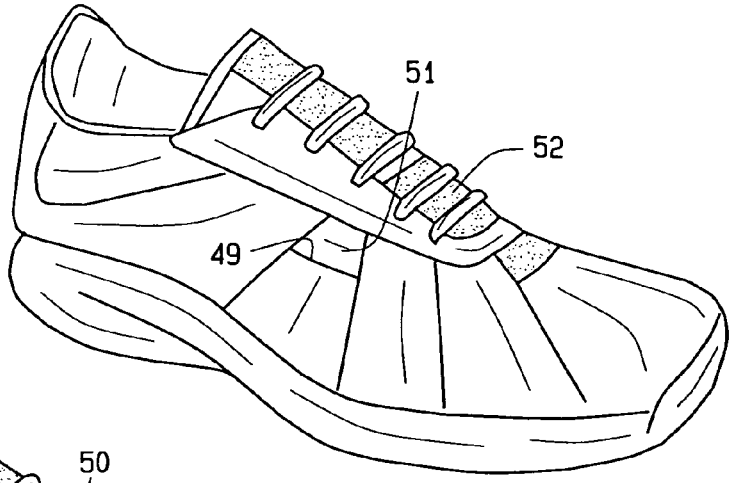
FIG. 15A shows another variation in the access opening provided through the footwear quarter portion to show a part of the circular tongue.
Figure 15B:
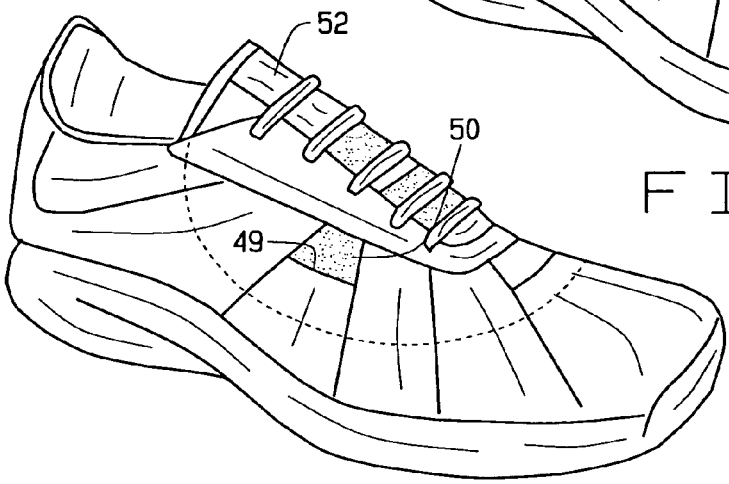
FIG. 15B shows the tongue partially rotated, to display a different coloration or design through the quarter portion opening.

FIGS. 15A and 15B compliment the concept providing apertures, as at 49, provided through the upper quarter portions of the shown shoe, so that a tongue coloration, either a dark color, as at 50, or a light color, as at 51, may show therethrough, to add to the enhanced design and coloration for the shoe, as the tongue is being rotated. Rotation of the tongue will also present a different coloration or pattern through the opening O, as can be seen at 52. As further shown in these two views, any mesh on the tongue, when lined up with openings in the shoe quarter, or extends upwardly or downwardly within the lacing opening, can be used to enhance the ventilation and breathability of the shoe, for furnishing some degree of aeration of the overlying foot, upon which the shoe is applied.

Figure 16C:
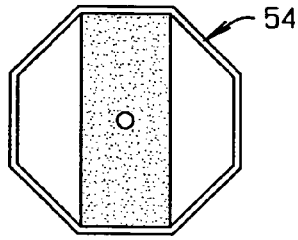
FIG. 16A shows another style shaped tongue held in position by means of the footwear crossbar.
FIG. 16B shows the tongue turned, approximately a quarter turn, to disclose a different coloration and design for the pivotal tongue.
Figure 16A:
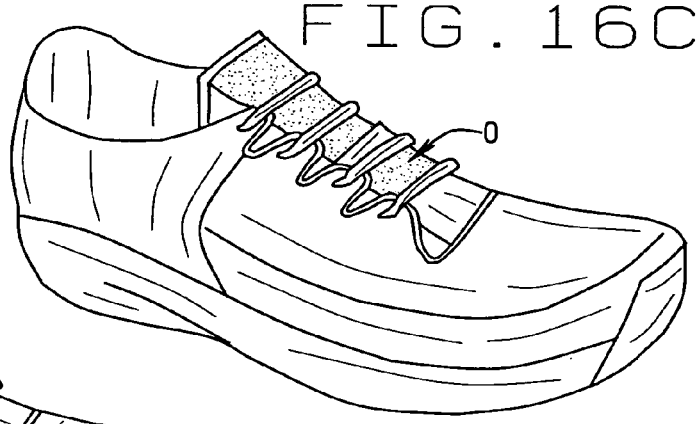
Figure 16B:
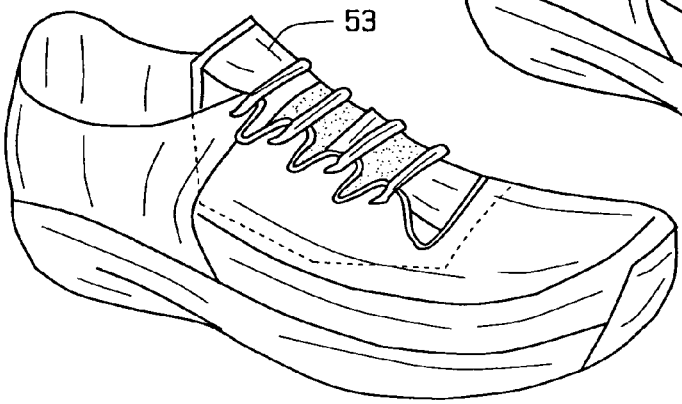

As can be seen in FIG. 16, and as previously alluded to, the tongue 53 when in place, may add different colorations for exposure through the opening O, and the shape of the tongue may undertake other configurations, such as the octagonal shape as disclosed at 54 in FIG. 16C.

In addition, as can be noted in FIGS. 17A and 17B, the tongue may be applied within a slip on type of footwear. The tongue 55 simply connects to its crossbar 56, in the manner as previously described, and the coloration of the tongue will be exposed within the opening O, or through the series of apertures 57 provided through the upper quarter portion of the shown slip on footwear. These are examples as to how the concept of this invention may be embodied within many different styles of shoes or footwear, and be readily manipulated, to change and enhance the appearance, design, breathable performance, and configuration of the tongue as it shows through the shoe openings. It is just as likely that the tongue may also have a shape that is of a more rectangular pattern, with one coloration on the top, and another coloration on the bottom, and the tongue simply being revolved, so as to display the most prominent color upwardly of the shoe opening, during its usage.

FIGS. 18 and 18A disclose the rotating mechanism, as at 16, that is attached to the upper quarter portions of the footwear, are connected across the lacing openings provided at the top of such shoes, to dispose the pivoting tongue, or pinwheel, as at 61, in a position where, when it is turned, will display different coloration or indicia, as upon its surfaces 62, during usage. The upper part of the rotating mechanism, as at 63, may be permanently affixed to the spanning member 64 and may be appended to the opposite approximate edges of the upper quarter portions for the footwear as shown. Thus, as can be seen by the illustrative arrows, as at 65, the rotatable member can be turned, which likewise turns the pivotal tongue 61, as desired by the wearer.

FIGS. 19 and 19A show a further variation upon the rotatable mechanism 66. In this instance, the mechanism is attached to the pivotal tongue or member 67, and likewise connects with the spanning member or other fixed member 68 which attaches to the footwear, in a more permanent fashion. Thus, turning of the rotatable member 66 allows the pivotal tongue or other member to pivot or rotate, to display different designs or colorations as previously referred to.

Figure 20:
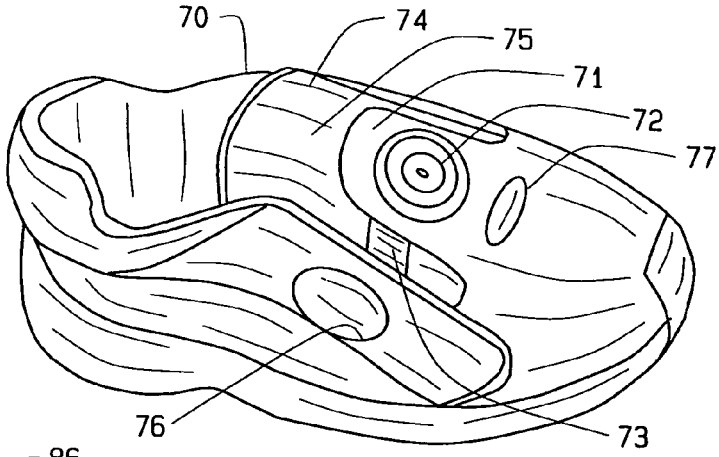
FIG. 20 shows a shoe having a rotating tongue attaching to the upper vamp and disclosing, through a cutout, different indicia as the tongue is turned through its rotating mechanism.

FIG. 20 shows how the rotatable structures as previously defined can actually be applied to footwear. For example, the shown shoe, as at 70, has an upwardly extending partial vamp, as at 71, which may form a shallow tongue, and the rotatable member, of the type as previously defined, is applied to the vamp as can be seen at 72. The spanning member that fixes the rotatable member in place, is shown at 73, and the pivotal or routable tongue as disclosed at 74. Thus, when the outer knob of the rotatable member 72 is turned, the tongue 74 turns with it, which may display different colorations upon its surface, as at 75, or display different indicia or coloration through the openings 76 (one provided on each quarter portion), or the vamp opening 77 since the pivotal tongue underlies said openings and is displayed therethrough, as the tongue is rotated. This is an example as to how the variety of colorations for the pivotal tongue may be exhibited, through various aspects of the disclosed footwear, during usage and application.

Figure 21:
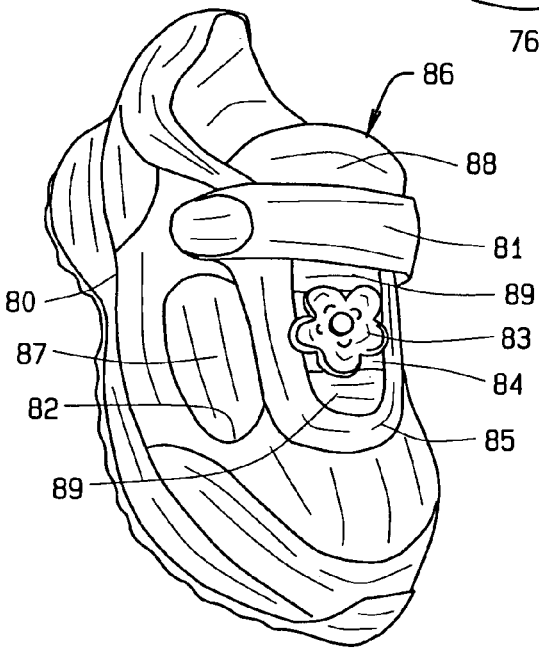
FIG. 21 shows a variation upon footwear disclosing the rotating mechanism for turning of the pivotal tongue, a portion of which shows through an opening provided through the upper quarter portions of the shown shoe.

FIG. 21 shows another variation upon a style of shoe, as at 80, or other type that has a fastening band, is as at 81, spanning across the upper quarter portions of the shown shoe. The shoe has a series of openings provided therethrough, one as shown through the upper quarter portion, as at 82, and the rotatable member, in this instance, as at 83, is held by the spanning member 84 affixes to the lacing margin, as at 85, to secure the pivotal member in place. In this instance, there may be no lacings provided, but the pivotal tongue, as at 86, is capable of being turned by the knob 83, for displaying its various tongue surfaces, as at 87, 88, and at the vicinity of 89, for a display of a variety of coloration, indicia, or other designs, thereat, so as to vary the aesthetic appearance of the shown shoe, during usage and application of invention.

Figure 22B:
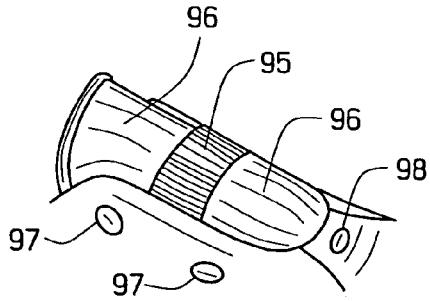
FIG. 22B shows an elastic means spanning the space across the lacing opening, and having a pivotal tongue arranged there under disposed for being rotated.
Figure 22A:
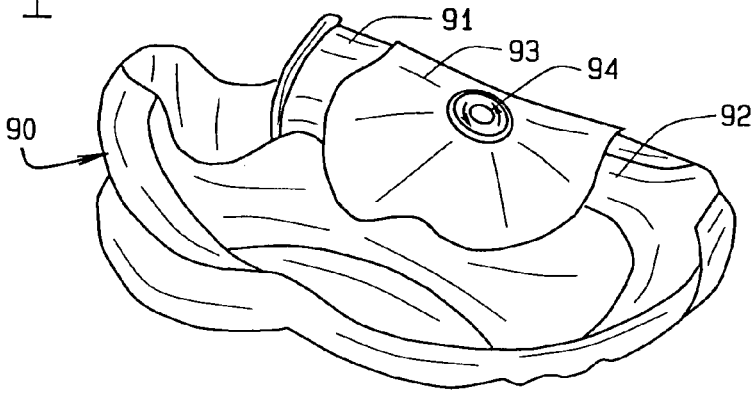
FIG. 22A shows a variation upon a shoe having the rotating mechanism, of FIG. 18, provided upon the upper vamp for rotating of the pivotal tongue.

FIGS. 22A and 22B disclose a footwear 90, which in this particular instance, the footwear may include a tongue, as in 91, extending up from its vamp 92, but in this instance, a pinwheel or pivotal overlay, as at 93, may be fixed in the position for rotation, by means of the rotatable member 94, so as to provide a complete coloration or design display, that can be rotated about the underlying shoe and its tongue, which can be fixed in the position by means of Velcro, or other fastening member, to add a unique appearance to the shown shoe. Conventional tongue 91 may be provided beneath the rotating pinwheel, as can be understood. In addition, FIG. 22B shows how the rotating mechanism 94 may affix to a spanning member 95, in its overlying of the conventional tongue. Or, the pinwheel of this design may be located beneath the spanning member 95, held in position by means of a rotatable member 94, so that when the tongue is rotated, or pivoted, it will not only be displayed along its surfaces 96 but also through the strategically located apertures 97, and 98, provided through the respective quarter portions and upper vamp of the footwear to which it attaches.

Figure 23:
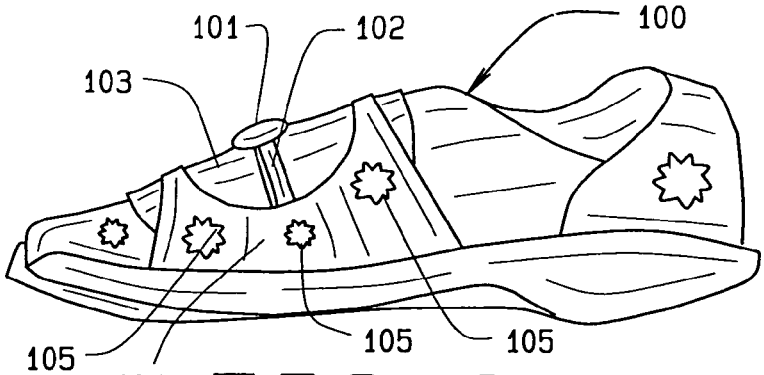
FIG. 23 shows a variation upon footwear, in the form of a sandal, having a spanning member supporting the rotating device for turning of its attached pivotal tongue.

FIG. 23 shows a shoe, somewhat in the configuration of a sandal, as at 100, and shows how the rotatable member 101 attaches to a spanning member 102, to hold the rotatable tongue or pinwheel 103 in place. Rotating of the rotatable member 101 allows the tongue to pivot, so that it may be displayed along those portions which extend beyond the integral footwear strap 104, but in addition, allow the rotatable tongue to show through the openings 105 provided through the footwear strap, as explained. Thus, the openings, as at 105, will display the different colorations for the pivotal tongue or pinwheel 103, as it is turned.

Figure 24:
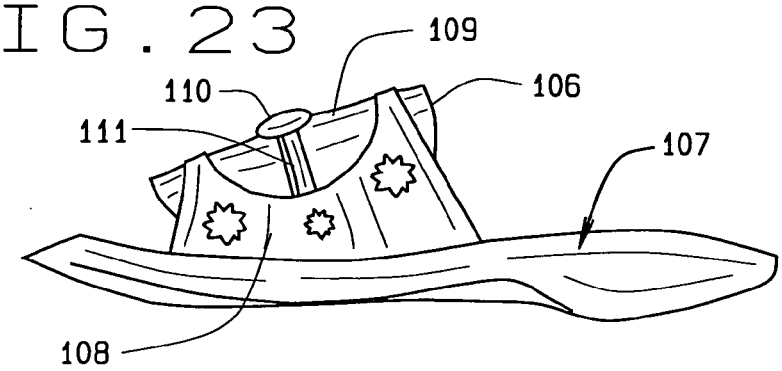
FIG. 24 shows a variation upon the same type of footwear, as in FIG. 23, disclosing how the rotatable tongue can be turned for display through the lateral openings furnished as in the shown sandal.

FIG. 24 shows how the structure of the pinwheel, as at 106, may be applied in a similar manner to a sandal, of the type as shown at 107. The sandal strap 108 provides an upper opening through which the rotatable tongue or pinwheel 109 is displayed, with the rotatable mechanism 110 being affixed by the spanning member 111 to allow for turning of the pinwheel, during its usage and application.

Figure 25:
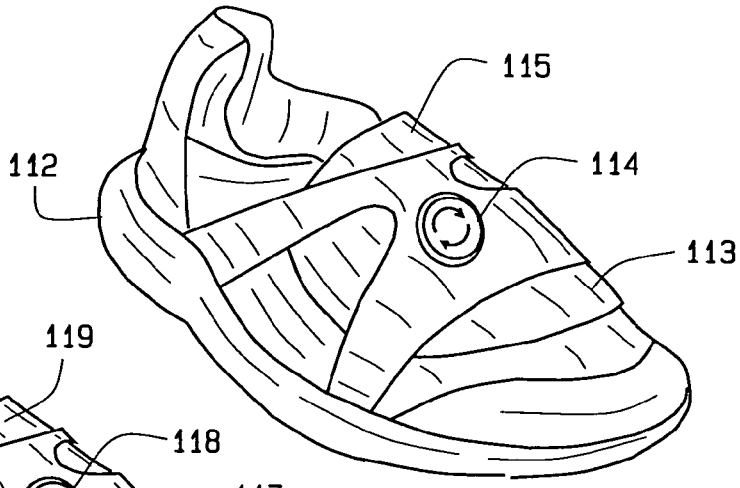
FIG. 25 shows another form of footwear, a spanning compound strap extending across the shoe, and holding the rotating mechanism for turning of the pivotal tongue arranged under the said straps.

FIG. 25 discloses a sandal or slide 112, wherein spanning member 113 holds the rotatable member 114 in position, for securement of the pivotal tongue 115 or pinwheel. Thus, turning of the rotatable member allows the pinwheel or tongue 115 to rotate, to display differing indicia.

Figure 26:
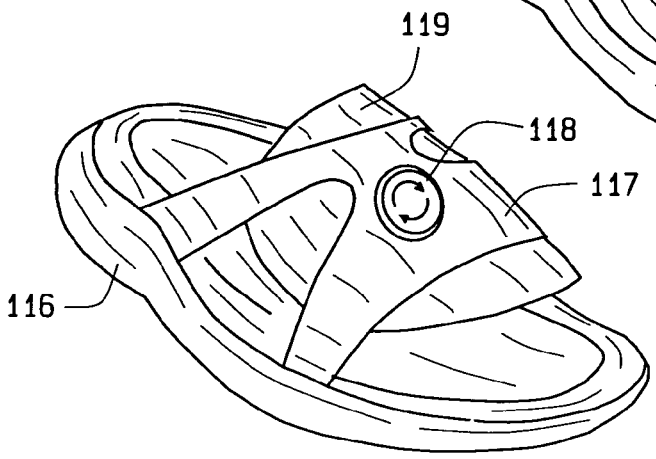
FIG. 26 shows a similar type of shoe, in the form of sandal, having a spanning strap that holds the rotating mechanism for turning of the pivotal tongue.

FIG. 26 shows a further variation upon a type of slide, 116 having the spanning member 117 supporting the rotatable member 118, and its attached pinwheel 119 for rotation, in the manner ia explained with respect to the sandal as shown in FIG. 25.

Figure 27:
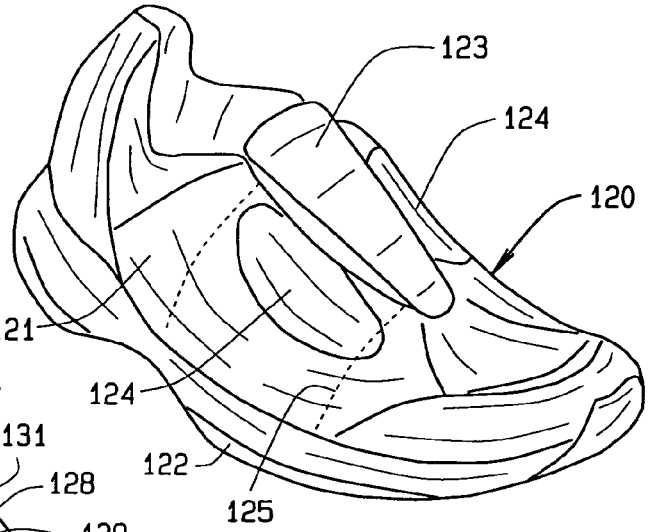
FIG. 27 discloses a shoe with its tongue and having a pivotal member arranged there below for display through the openings provided in the upper quarter portions of the shown shoe.
Figure 28:
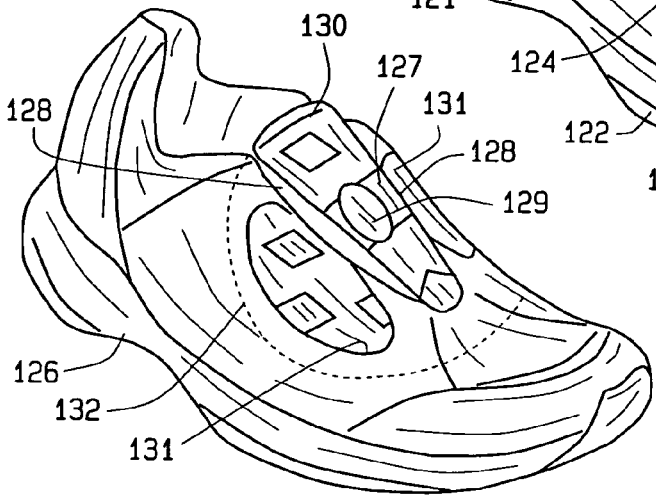
FIG. 28 shows a similar shoe to that of FIG. 27, and disclosing our rotating of the tongue can display different indicia within the quarter portion openings.

FIG. 27 shows a conventional shoe or slipon, as at 20, having quarter portions 121, a sole 122, and an affixed tongue 123, as can be noted. In this instance, the upper quarter portions may incorporate openings, as at 124, wherein the elastic member therebeneath, as at 125, will be shown, in order to provide a different color or design at that location. FIG. 28 shows how a similar type of footwear 126 may be constructed, with a spanning member 127 spanning the space between the upper edges of the lacing opening 128, and the rotatable member 129 furnishing support for the pivotal tongue or pinwheel 130 when turned, and which can display a variety of indicia, designs, or the like, either through the lacing openings, or through the openings as at 131, as furnished through the upper quarter portions of the shown shoe. The actual spanning of the pivotal member 130 can be seen as the perimeter and circumferential edge, as disclosed at 132, as disclosed in hidden line.

Figure 29:
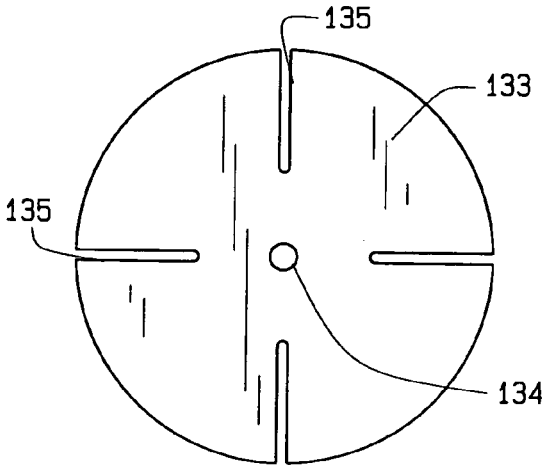
FIG. 29 shows a style of pivotal tongue having slots therein and which can be held by a rotating mechanism to the footwear tongue or upper vamp and being capable of being turned for display of differing indicia.
Figure 30:
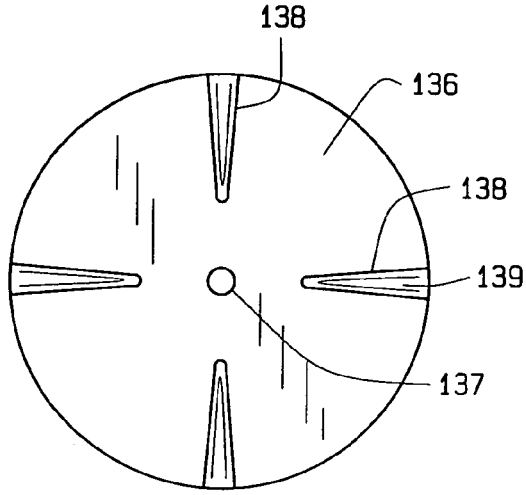
FIG. 30 shows another variation upon a rotatable or pivotal tongue.

FIG. 29 shows a type of pinwheel or tongue, as at 133, which may be employed in the various footwear, sandals and slides, as previously explained. It has a center opening 134 for connection to a rotatable member (not shown herein) and said pivotal member may have a series of slots as at 135, which may aid in the conformance of the curvature of the tongue or pinwheel to the underlying foot, when the device is integrated in to the structure of any one of the shown footwear. FIG. 30 shows another variation upon a style of pinwheel, as at 136, having a center opening for accommodating the connection of the rotatable member thereto, said opening being shown at 137, and various slots 138 to aid in the conformity of the tongue to the foot located within the footwear during its wearing. There may even be provided plastic inserts, as at 139, within the slots 138, to aid in the conformance of the tongue or pinwheel to the foot, when the shoe is worn.

Figure 31:
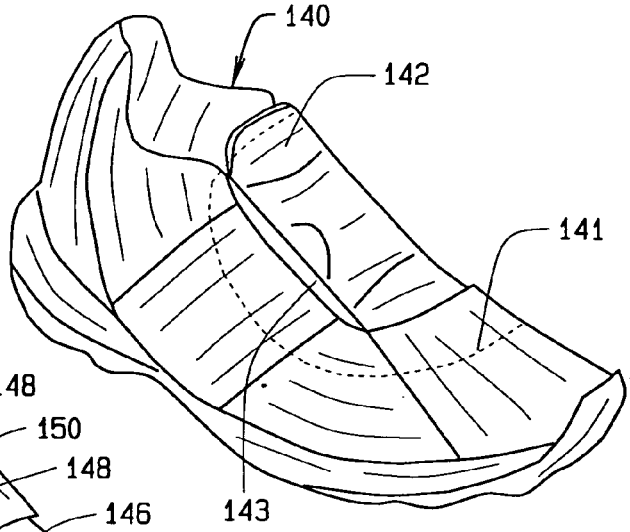
FIG. 31 discloses a standard footwear with its integral tongue but having rotatable tongue provided there under and capable of being displayed through various openings.
Figure 32:
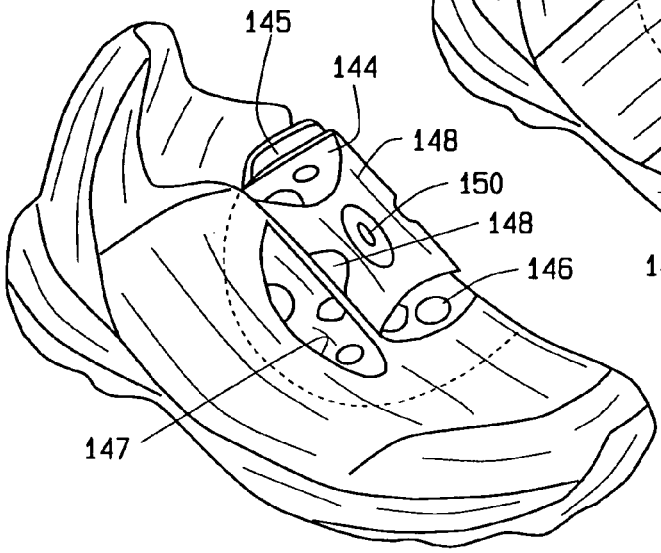
FIG. 32 shows a variation upon the footwear of FIG. 31, and showing how the pivotal tongue can be displayed above and below the spanning member provided between the upper quarter portions, and likewise, said pivotal tongue can be displayed through openings provided in the upper quarter portion of the shown shoe.

The shoe as shown in FIG. 31, as at 40, incorporates a rotatable tongue or pinwheel, as at 141, it may locate beneath the shown shoe gusset or tongue 142, and can be displayed through the various areas of opening, as at 143, to display different colorations, as can be seen. Or, as shown in FIG. 32, the rotatable tongue or pinwheel 144 may be arranged above the shown tongue 145, to display more of its designs, as at 146, through various opening, such as the slot 147 as provided at the upper quarter portions of the shoes, or those openings provided laterally of the spanning member 148 such as at 149, or at the top or bottoms of the spanning member, at the vicinity of 144 and 146, when applied. A rotatable member 150 may be employed for holding the pivotal tongue or pinwheel to the spanning member 148, when installed. Simply turning the knob of the rotatable member allows for turning of the tongue to display different colorations, designs, or indicia, during its usage and application.

Figure 33:
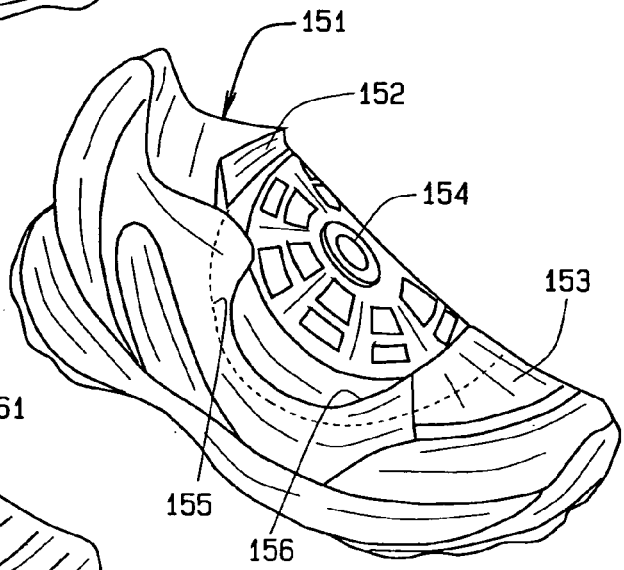
FIG. 33 shows a footwear incorporating a member that supports and functions as a carrier for the rotating overlay or tongue that may be pivoted to provide a display of differing indicia.

FIG. 33 shows another style of footwear, as at 151. Since this shoe may incorporate a padded tongue as at 152, connecting with the vamp 153 on the shown shoe, a rotatable member 154 may hold the pivotal tongue or pinwheel, as at 155 to the upper exterior of the gusset 152, and which when turned, provides a variety of colorations or displays through the expansive opening, as at 156, furnished at the upper segment of the shown footwear.

Figure 34:
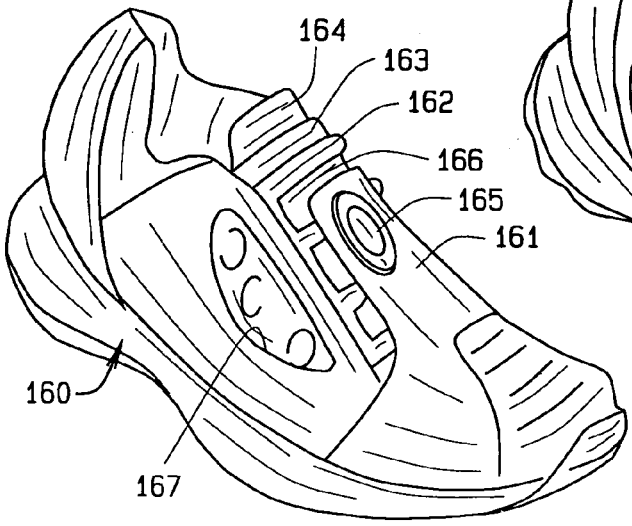
FIG. 34 shows how the rotating tongue can be affixed to the upper vamp, within the region of the shoe tongue, and when pivoted, providing a display through various openings and through the slots provided at the upper quarter portion of the shown shoe.

FIG. 34 shows a related design, where the footwear 160 has an upward extending vamp 161, a series of spanning members as at 162 across the eye-stay opening for the shown shoe. A rotatable tongue or pinwheel 163 is arranged above the shoe gusset 164, when rotated by turning of the rotatable mechanism 165 to display the pivotal tongue through various openings, as at 166, or through the openings provides as at 167 in the upper quarter portions of the shown shoe.

It is also likely that the pinwheel design, as shown herein, may be of a smaller diameter, and may locate directly within the shoe tongue or gusset, which when turned, can display various colorations through slots or openings that may be provided through the upper surface of the tongue, in order to vary the aesthetics of the shown shoes.

Figure 35A:
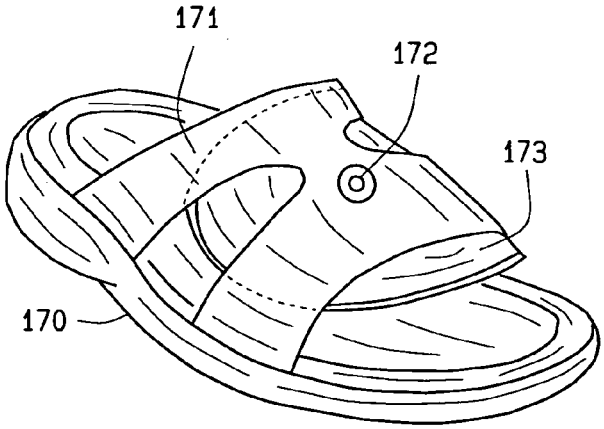
FIGS. 35A-C shows sandals incorporating the rotatable tongue of this invention.
Figure 35B:
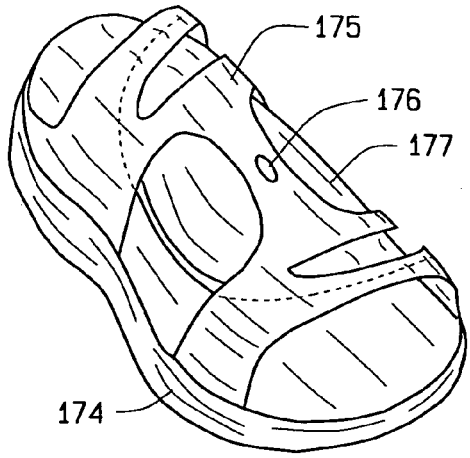
Figure 35C:
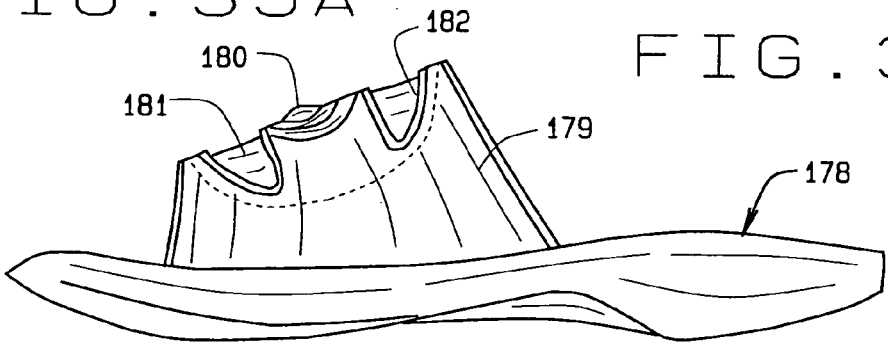

FIG. 35A shows a sandal, as at 70, where its spanning strap 171 provides support of the rotatable member 172, which in turn holds the pivotal tongue or pinwheel 173 in position for rotation. FIG. 35B shows a variation upon a sandal or slide, as at 174, where the spanning strap or member 175 accommodates the rotatable member 176 thereon, holding the rotatable tongue or pinwheel 177 in position for turning, under the shown spanning member, allowing it to be rotated, for displaying different coloration or indicia. FIG. 35C shows another slide, as at 178, where its spanning strap 179 holds the rotatable member 180 for supporting its pinwheel 181 for turning, and display, through the slots 182 provided therein.

Figure 36B:
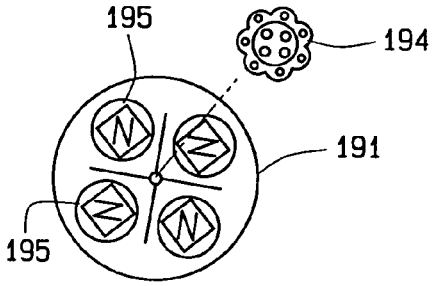
FIG. 36B shows the rotatable member, with its turning knob, the type as used in conjunction with the footwear of FIG. 36*a;*
Figure 36A:
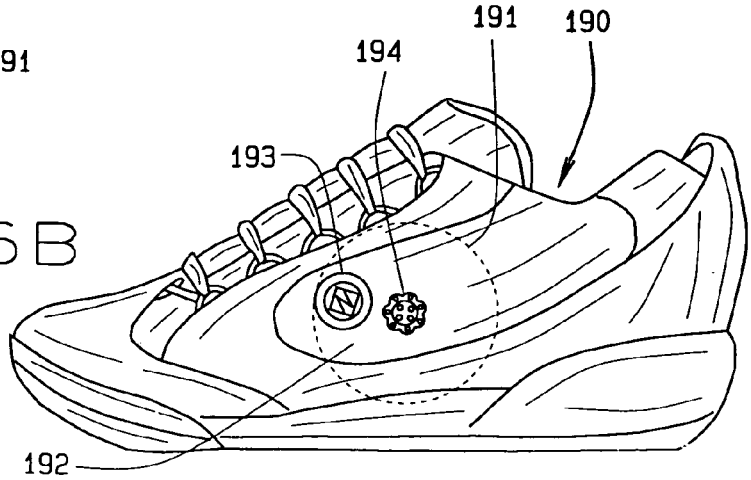
FIG. 36A discloses a walking shoe having a rotatable member pivotally mounted to the quarter portion, to display different indicia through an opening furnished through the said quarter portion of the shown footwear.

FIG. 36A discloses a walking, running, or other low-cut athletic shoe, as at 190, wherein the pinwheel, as at 191 connects to the quarter portion 192 of the shown shoe. Then, various openings, as at 193, may be provided through the quarter portion, so as to display the underlying pinwheel, and to vary the indicia or design, of the shown shoe. FIG. 36B shows how the rotatable mechanism 194 can connect with the pinwheel 191, through to any type of fastening mechanism, such as a rivet, fastener, or the like, with the pinwheel displaying various indicia, such as initials, perhaps of different coloration, or school colors, as at 195, and which can be displayed through the opening 193, as through the quarter portion of the shown shoe.

Figure 37B:
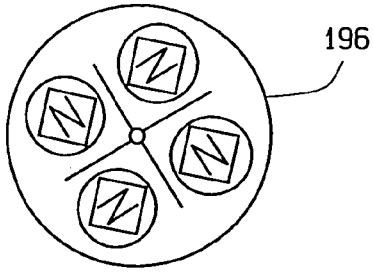
FIG. 37B shows the rotatable member for the shoe of FIG. 37*a;*
Figure 37A:
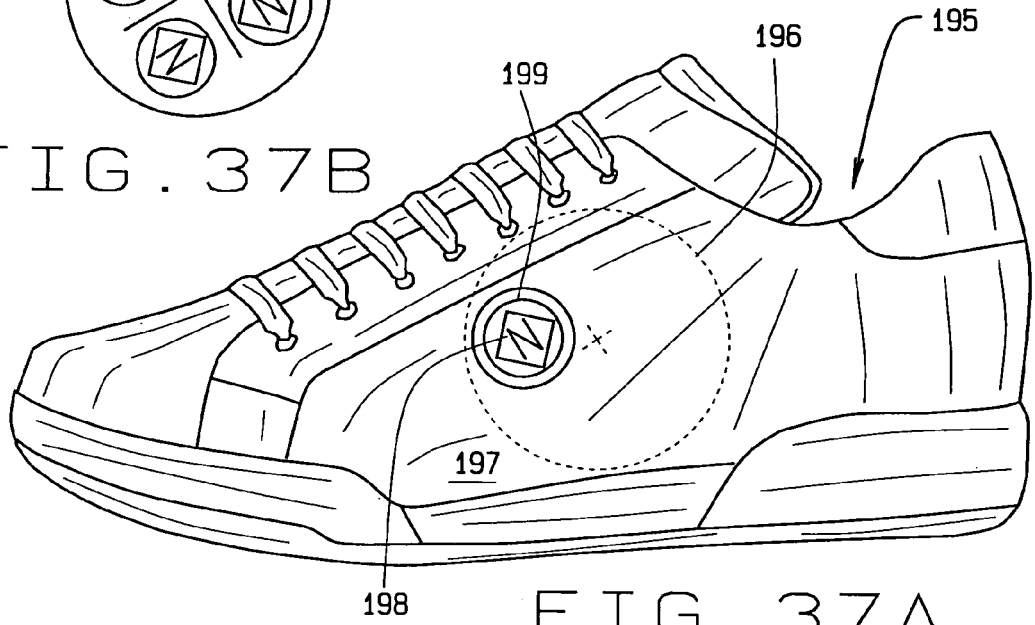
FIG. 37A shows a rotatable member also affixed to the quarter portion of the disclosed athletic shoe, and having an opening through which differing indicia may be displayed.

FIG. 37A discloses another athletic shoe, as at 195, showing how the pinwheel 196 may also connect to the quarter portion 197 of the shown shoe, wherein an initial or other indicia as at 198 may be displayed through the opening 199 for visualization. Any type of a rotatable mechanism, or dial (not shown), of the type as previously described, may affix to the exterior of the quarter portion, and fasten to the pinwheel 196, to provide for its convenient turning. The pinwheel itself is shown in FIG. 37B, at 196.

Figure 38B:
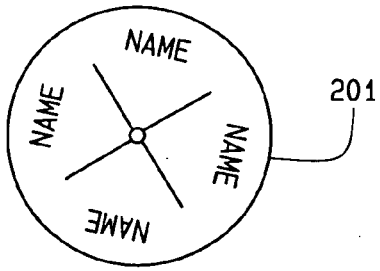
FIG. 38B shows the rotatable member as applied within the quarter portion of the shown shoe of FIG. 38*a;*
Figure 38A:
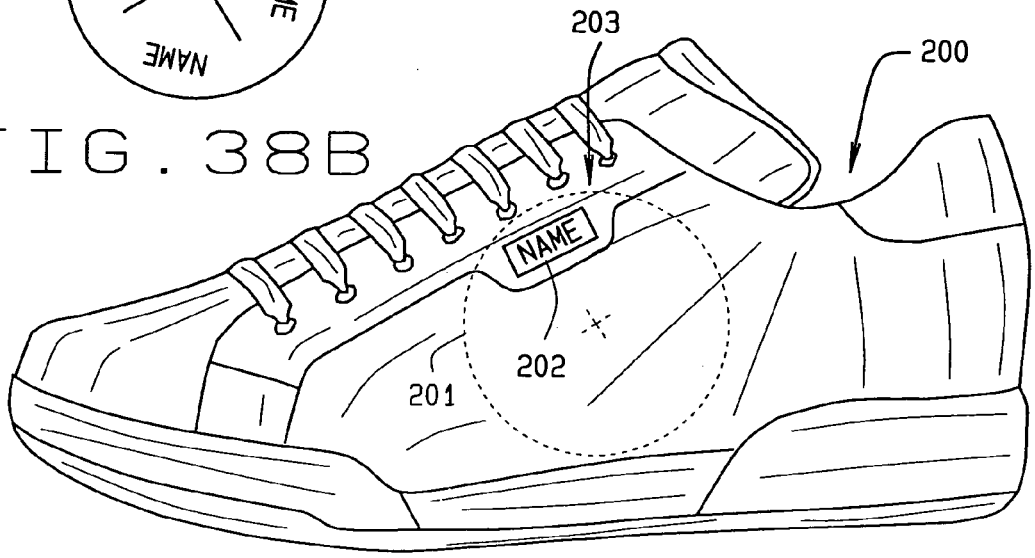
FIG. 38A shows a rotatable member for displaying a name, or other word, affixed to the quarter portion of the shown shoe.

A similar type of arrangement for a pinwheel design is disclosed in FIG. 38A. As shown, the footwear 200 is a similar type of pinwheel 201 affixed thereto. A slot 202 provided through the upper quarter portion, as along the lacing openings, as at 203, and can be provided for disclosing various names, as can be seen, when the pinwheel is turned, by any type of rotatable mechanism or dial (not shown), as previously referred to. The pinwheel is shown at 38B.

Figure 39A:
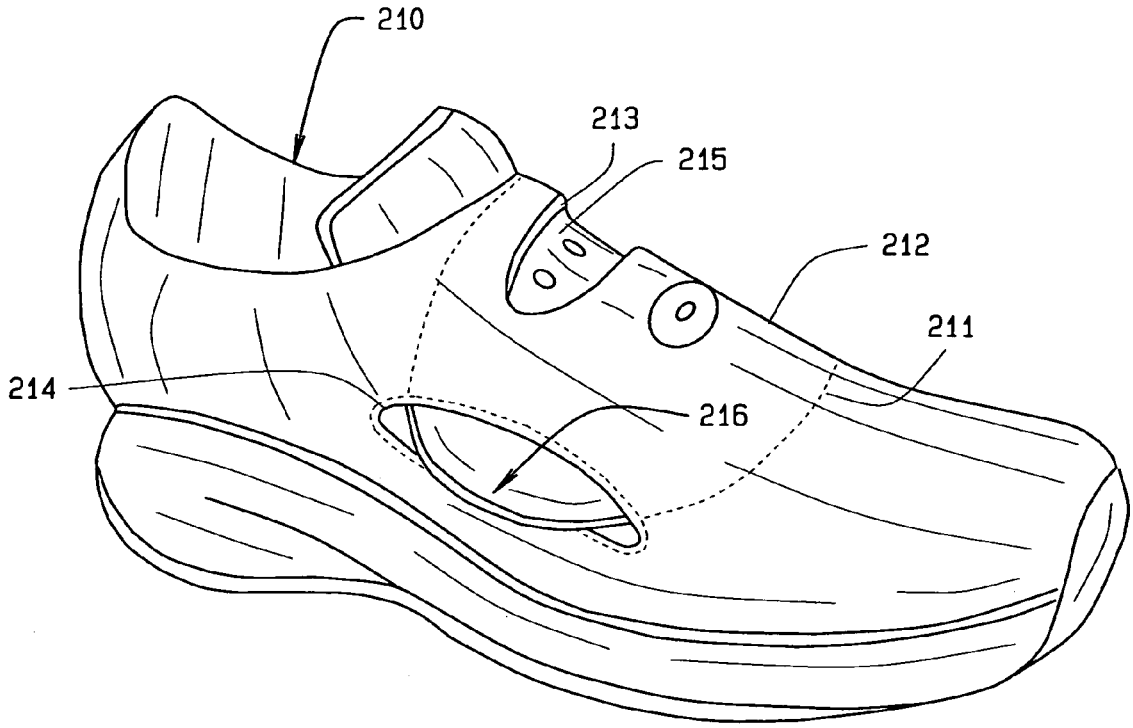
FIG. 39A discloses footwear incorporating a rotatable member, within the region of its upper vamp, and having a series of slots provided therethrough, for display of differing indicia or coloration by means of its rotatable member.
Figure 39B:
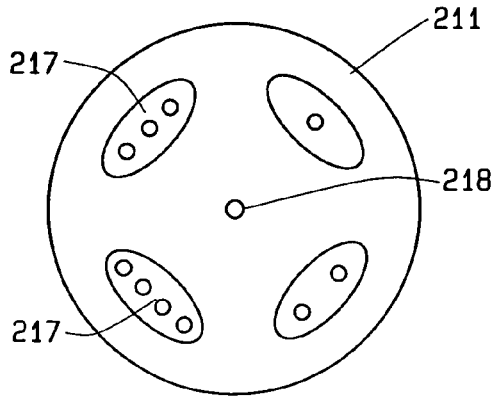
FIG. 39B shows the rotatable member for the footwear as disclosed in FIG. 39A.

FIG. 39A shows a further variation upon a style of slipon shoe, as at 210. As noted, a turnable tongue or pinwheel, as at 211, will be affixed by any one of the rotatable members (not shown) affixing the pinwheel to the upper vamp 212 of the shown shoe. Various slots may be provided within the upper vamp, as at 213, in addition to providing slots to one or both sides of the quarter portions of the shown shoe, as at 214. Cutouts provide for display of the pinwheel 215, through the vamp, or as at 216, for display through the quarter portions slot 214, as can be noted. As can be seen, even a portion of the pinwheel may extend through the slot to add to the variation of appearance for the shoe, when worn, and its pivotal tongue or pinwheel is manipulated in a manner as previously described. The pinwheel itself with its various designs and indicia, is seen in FIG. 39B. Segments of indicia, as at 217, are provided upon the shown pinwheel 211, during its fabrication. An aperture, as at 218, may cooperate with any type of a fastener, that holds a rotatable mechanism, knob or dial (not shown) the latter providing for turning of the pinwheel, when any one of them are rotated, manually.

Figure 40:
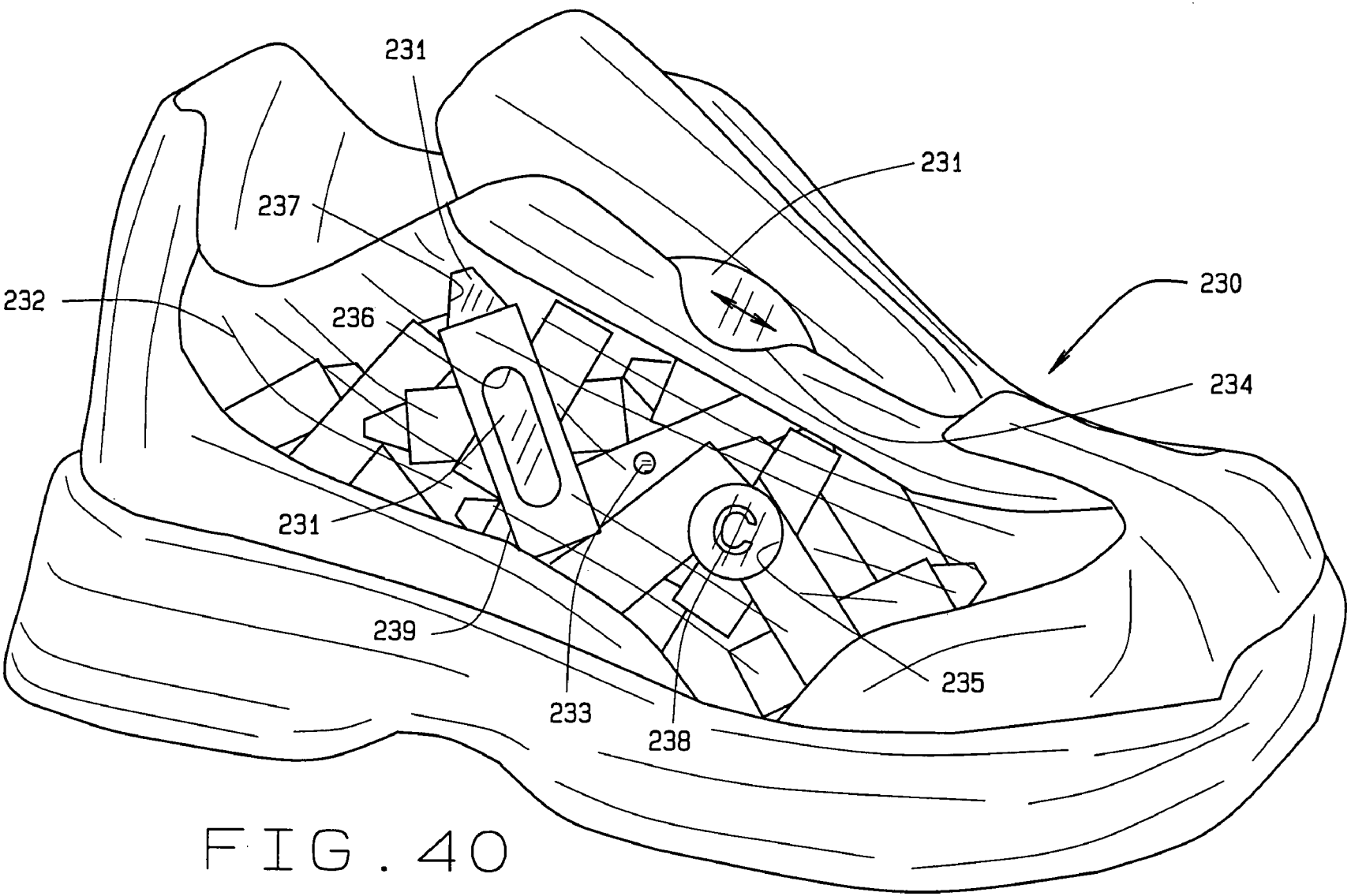
FIG. 40 shows footwear with means for turning a rotatable member pivotally mounted to the quarter portion, to display different indicia, coloration, or other designs through one or more openings furnished within the quarter portion of the shown footwear.

In referring to FIG. 40, therein as shown a footwear 230, wherein a pivotal member 231 is connected within the quarter portion 232 by means of a pivot member 233. Thus, with the clearance 234 provided at the cutout segment furnished at the upper edge of the quarter portion, the pivotal member 231 can be grasped by the footwear user, and turned, as desired. Thus, the pivotal member may contain various and different indicia, such as trademarks, designs, and even variable colorations, so that as the pivotal member is turned, these displays will be shown through the cutouts, as at 235 through 237, as can be noted. For example, the cutout 235 is similar to what has been explained relative to the previous footwear described in this application, and is herein shown as a circular cutout, so that the design, such as a trademark C as at 238, shows through the opening. This may be a trademark of the manufacturer and marketer, that allows for the display, or even the initial of the wearer, or any other type of trademark, design or indicia as may be desired. In addition, as can be seen, the footwear displays a series of crayons, as at 239, and at this particular instance, it includes a cutout segment as previously identified at 236, shown the side of the crayon, while the cutout 237 is of the upper tip of the crayon, as can be seen. Thus, various colorations may be shown for the pivotal member 231, as it is turned, and these colors will appear at these portions of the shown crayons, so that the wearer, such as a child, may display different colors, for the crayons as shown, while wearing the shoes. Obviously, other types of designs, other than crayons, could be provided upon the surface of the quarter portion, as noted, and have various cutout segments through which other designs, colorations, or the like, will be displayed, so add to the versatility of the coloration and esthetics of the footwear, as it is worn.

Variations or modifications to the subject matter of this development may occur to those skilled in the art upon review of the invention as described herein. Such variations, if within the spirit and concept of this development, are intended to be encompassed within the scope of the invention as provided herein. The depiction of the preferred embodiment, and as shown in the drawings, in addition to its specific description within the preferred embodiment, are set forth for illustrative purposes only.

The invention claimed is:

1. Footwear having a pivotal pinwheel connected thereto, said footwear incorporating a shoe sole, said shoe sole having a shoe upper applied thereto, said shoe upper formed having a quarter portion provided to either side of the shoe, said quarter portions being affixed to the shoe sole, said pinwheel being mounted for pivotal movement to at least one of the quarter portions, and for pivoting relative thereto, whereby upon pivoting of the pinwheel it turns to display indicia or coloration, and wherein the quarter portion along its upper edge has a cut out segment, with a portion of the pinwheel displayed therethrough, to provide for accessibility to the pinwheel to allow for its rotation when displaying differing indicia or coloration.

2. The footwear of claim 1 wherein each quarter portion to which a pinwheel connects has at least one slot provided therethrough, the pivotal pinwheel being displayed through the quarter portions slot whereby upon turning of the pinwheel it displays differing coloration or indicia through the at least one slot of the overlaying quarter portion.

3. The footwear of claim 1 wherein said pivotal pinwheel connects by a rotatable member to each side quarter portion of the formed shoe, whereby each pinwheel may be fully rotated by a rotatable member to display differing coloration or indicia through respective said quarter portion slots.

4. Footwear having a pivotal pinwheel connected thereto, said footwear incorporate a shoe sole, said shoe sole having a shoe upper applied thereto, said shoe upper formed having a quarter portion provided to either side of the shoe, said quarter portion being affixed to the shoe sole, said pinwheel being mounted to at least one of said quarter portions for pivoting relative thereto, a rotatable member pivotally mounted to the quarter portion, said rotatable member being affixed to the pinwheel, each quarter portion to which the pinwheel connects has at least one slot provided therethrough, the pivotal pinwheel being displayed through the quarter portions slot, whereby upon rotating of the rotatable member said pinwheel pivots to display differing coloration or indicia through to at least one slot of the overlying quarter portion.

5. The footwear of claim 1 wherein the pinwheel displays an initial through the quarter portion aperture.

6. The footwear of claim 1 wherein the pinwheel displays a name through the quarter portion slot when adjusted.

7. The footwear of claim 1 wherein the pinwheel extends through a quarter portion slat during its turning.

* * * * *